US008416228B2

(12) United States Patent
Shoji et al.

(10) Patent No.: US 8,416,228 B2
(45) Date of Patent: Apr. 9, 2013

(54) DRIVING DEVICE, DRIVING METHOD AND PLASMA DISPLAY APPARATUS

(75) Inventors: Hidehiko Shoji, Osaka (JP); Takahiko Origuchi, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/677,565

(22) PCT Filed: Aug. 20, 2008

(86) PCT No.: PCT/JP2008/002253

§ 371 (c)(1),
(2), (4) Date: Mar. 11, 2010

(87) PCT Pub. No.: WO2009/040983

PCT Pub. Date: Apr. 2, 2009

(65) Prior Publication Data

US 2010/0207917 A1 Aug. 19, 2010

(30) Foreign Application Priority Data

Sep. 26, 2007 (JP) ..... 2007-248916

(51) Int. Cl.
*G09G 5/00* (2006.01)

(52) U.S. Cl. ..... 345/208; 345/204; 345/205; 345/209; 345/210; 345/211

(58) Field of Classification Search ..... 345/60–69, 345/204–214, 690; 315/169.1–169.4, 204, 315/217; 313/581–587, 631
See application file for complete search history.

(56) References Cited

U.S. PATENT DOCUMENTS 6,037,916 A * 3/2000 Amemiya ..... 345/60
6,479,943 B2 * 11/2002 Shigeta et al. ..... 315/169.4
6,614,413 B2 * 9/2003 Tokunaga et al. ..... 345/63
6,653,993 B1 11/2003 Nagao et al.
6,816,136 B2 * 11/2004 Tanaka et al. ..... 345/66
(Continued)

FOREIGN PATENT DOCUMENTS

EP 1835481 9/2007
EP 2063407 5/2009
(Continued)

OTHER PUBLICATIONS

Japan Office Action, mailed Jun. 5, 2012, in the corresponding Japanese Application.

(Continued)

*Primary Examiner* — Prabodh M Dharia
(74) *Attorney, Agent, or Firm* — Greenblum & Bernstein, P.L.C.

(57) ABSTRACT

In a plasma display panel apparatus, luminance when a display state of a panel is all-black is reduced. In a first period, in which a first ramp waveform dropping from a first potential to a second potential is applied to a plurality of scan electrodes, within a setup period, a second ramp waveform dropping from a third potential to a fourth potential is applied to a plurality of sustain electrodes in a second period in the case of not all-black, and a third ramp waveform dropping from the third potential to a fifth potential is applied to the plurality of sustain electrodes in a third period which is longer than the second period in the case of all-black. In addition, a scan pulse is not applied to the plurality of scan electrodes in a write period in the case of all-black.

7 Claims, 15 Drawing Sheets

U.S. PATENT DOCUMENTS

| | | | | |
|---|---|---|---|---|
| 7,453,492 | B2 * | 11/2008 | Silverbrook | 348/207.2 |
| 7,583,241 | B2 * | 9/2009 | Jung | 345/60 |
| 8,228,265 | B2 * | 7/2012 | Origuchi et al. | 345/63 |
| 2002/0030671 | A1 * | 3/2002 | Shigeta et al. | 345/204 |
| 2002/0118149 | A1 | 8/2002 | Tanaka et al. | |
| 2002/0180669 | A1 | 12/2002 | Kim et al. | |
| 2003/0107532 | A1 | 6/2003 | Choi | |
| 2004/0001036 | A1 * | 1/2004 | Takayama et al. | 345/62 |
| 2004/0021622 | A1 | 2/2004 | Nagao et al. | |
| 2004/0085305 | A1 * | 5/2004 | Kunii et al. | 345/204 |
| 2005/0088371 | A1 * | 4/2005 | Heo | 345/60 |
| 2005/0093853 | A1 | 5/2005 | Kim | |
| 2005/0116901 | A1 | 6/2005 | Kim et al. | |
| 2006/0109213 | A1 * | 5/2006 | Chae et al. | 345/67 |
| 2006/0114183 | A1 * | 6/2006 | Jung et al. | 345/67 |
| 2006/0139246 | A1 | 6/2006 | Choi | |
| 2006/0232523 | A1 * | 10/2006 | Hori et al. | 345/76 |
| 2007/0216608 | A1 | 9/2007 | Choi | |
| 2008/0055203 | A1 | 3/2008 | Nagao et al. | |
| 2008/0062080 | A1 | 3/2008 | Nagao et al. | |
| 2008/0062081 | A1 | 3/2008 | Nagao et al. | |
| 2008/0062082 | A1 | 3/2008 | Nagao et al. | |
| 2008/0062085 | A1 | 3/2008 | Nagao et al. | |
| 2008/0068302 | A1 | 3/2008 | Nagao et al. | |
| 2008/0068303 | A1 | 3/2008 | Nagao et al. | |
| 2008/0079667 | A1 | 4/2008 | Nagao et al. | |
| 2008/0150838 | A1 | 6/2008 | Nagao et al. | |
| 2008/0165170 | A1 | 7/2008 | Nagao et al. | |
| 2009/0085838 | A1 * | 4/2009 | Origuchi et al. | 345/60 |
| 2010/0060627 | A1 | 3/2010 | Origuchi et al. | |
| 2010/0066718 | A1 | 3/2010 | Kuranuki et al. | |
| 2010/0066721 | A1 * | 3/2010 | Origuchi et al. | 345/213 |
| 2010/0103161 | A1 | 4/2010 | Origuchi et al. | |

FOREIGN PATENT DOCUMENTS

| | | |
|---|---|---|
| EP | 2063408 | 5/2009 |
| EP | 2088575 | 8/2009 |
| JP | 06-004039 | 1/1994 |
| JP | 10-171403 | 6/1998 |
| JP | 11-190984 | 7/1999 |
| JP | 2002-258794 | 9/2002 |
| JP | 2003-15599 | 1/2003 |
| JP | 2003-84712 | 3/2003 |
| JP | 2003-255888 | 9/2003 |
| JP | 2005-122102 | 5/2005 |
| JP | 2007-133291 | 5/2007 |
| JP | 2009-69271 | 4/2009 |
| JP | 2009-69512 | 4/2009 |
| WO | 2007/099600 | 9/2007 |
| WO | 2008/066084 | 6/2008 |
| WO | 2008/066085 | 6/2008 |
| WO | 2009/034681 | 3/2009 |

OTHER PUBLICATIONS

U.S. Appl. No. 12/669,826 to Origuchi et al., filed Jan. 20, 2010.
U.S. Appl. No. 12/677,223 to Origuchi et al., filed Mar. 9, 2010.

* cited by examiner

DRIVING DEVICE, DRIVING METHOD AND PLASMA DISPLAY APPARATUS

TECHNICAL FIELD

The present invention relates to a driving device and a driving method for selectively subjecting a plurality of discharge cells to discharge to cause images to be displayed on a plasma display panel, and a plasma display apparatus.

BACKGROUND ART

An AC surface discharge type panel that is typical as a plasma display panel (hereinafter abbreviated as a "panel") includes a number of discharge cells between a front plate and a back plate arranged to face each other.

The front plate is constituted by a front glass substrate, a plurality of display electrodes, a dielectric layer and a protective layer. Each display electrode is composed of a pair of scan electrode and sustain electrode. The plurality of display electrodes are formed in parallel with one another on the front glass substrate, and the dielectric layer and the protective layer are formed to cover the display electrodes.

The back plate is constituted by a back glass substrate, a plurality of data electrodes, a dielectric layer, a plurality of barrier ribs and phosphor layers. The plurality of data electrodes are formed in parallel with one another on the back glass substrate, and the dielectric layer is formed to cover the data electrodes. The plurality of barrier ribs are formed in parallel with the data electrodes, respectively, on the dielectric layer, and the phosphor layers of R (red), G (green) and B (blue) are formed on a surface of the dielectric layer and side surfaces of the barrier ribs.

The front plate and the back plate are arranged to face each other such that the display electrodes intersect with the data electrodes in three dimensions, and then sealed. An inside discharge space is filled with a discharge gas. The discharge cells are formed at respective portions at which the display electrodes and the data electrodes face one another.

In the panel having such a configuration, a gas discharge generates ultraviolet rays, which cause phosphors of R, G and B to be excited and to emit light in each of the discharge cells. Accordingly, color display is performed. Note that one pixel on the panel is constituted by three discharge cells including the phosphors of R, G and B, respectively.

A sub-field method is employed as a method of driving the panel. In the sub-field method, one field period is divided into a plurality of sub-fields, and the discharge cells are caused to emit light or not in the respective sub-fields, so that gray scale display is performed. Each of the sub-fields has a setup period, a write period and a sustain period.

In the setup period, a weak discharge (setup discharge) is performed to form wall charges required for a subsequent write operation in each discharge cell. In addition, the setup period has a function of generating priming for reducing a discharge time lag to stably generate a write discharge. Here, the priming means an excited particle that serves as an initiating agent for the discharge.

Note that the setup period includes a setup period for all cells in which all the discharge cells are discharged, and a selective setup period in which only discharge cells that have been subjected to sustain discharges are discharged. For example, the setup period for all cells is set at the first sub-field of one field period, and the selective setup period is set at each of the second sub-field and the following sub-fields of the one field period.

In the write period, scan pulses are applied to the scan electrodes in sequence while write pulses corresponding to image signals to be displayed are applied to the data electrodes. This selectively generates the write discharges between the scan electrodes and the data electrodes, causing the wall charges to be selectively formed.

In the subsequent sustain period, sustain pulses are applied between the scan electrodes and the sustain electrodes a predetermined number of times corresponding to luminances to be displayed. Accordingly, discharges are selectively induced in the discharge cells in which the wall charges have been formed by the write discharges, causing the discharge cells to emit light.

Here, in the foregoing setup period for all cells, respective voltages applied to the scan electrodes, the sustain electrodes and the data electrodes are adjusted in order to generate the weak discharges in the discharge cells.

Specifically, a ramp voltage gradually rising is applied to the scan electrodes while the voltages of the data electrodes and the sustain electrodes are held at a ground potential (reference voltage) in the first half of the setup period for all cells (hereinafter referred to as a rise period). This generates the weak discharges between the scan electrodes and the data electrodes and between the sustain electrodes and the data electrodes in the rise period.

Moreover, a ramp voltage gradually dropping is applied to the scan electrodes while the voltages of the data electrodes and the sustain electrodes are held at the ground potential in the second half of the setup period for all cells (hereinafter referred to as a drop period). This generates the weak discharges between the scan electrodes and the data electrodes and between the sustain electrodes and the data electrodes in the drop period.

As described above, Patent Document 1, for example, discloses the method of driving the panel in which the ramp voltage or the voltage gradually rising or dropping is applied to the scan electrodes during the setup period for all cells. Thus, the wall charges stored on the scan electrodes and sustain electrodes are erased, and the wall charges required for the write operation are stored on each of the scan electrodes, the sustain electrodes and the data electrodes.

[Patent Document 1] JP 2003-15599 A

DISCLOSURE OF THE INVENTION

Problems to be Solved by the Invention

All the discharge cells are brought into a non-emission state throughout one field period for displaying black on the entire panel. In this case, the write pulses are not applied to all the data electrodes in the write period. Thus, the write discharges are not generated in all the discharge cells, and all the discharge cells do not emit light in the subsequent sustain period. In this manner, black is displayed on the entire panel.

In this case, it is desired to decrease luminance of black displayed on the entire panel as much as possible for improving the contrast of images. As described above, however, complete zero light emission luminance is not achieved, because part or all of the discharge cells are subjected to the weak discharges in the setup period. As a result, the luminance of black displayed on the entire panel cannot be sufficiently decreased.

An object of the present invention is to provide a driving device and a driving method of a plasma display panel capable of sufficiently decreasing black luminance when all pixels display black, and a plasma display apparatus.

Means for Solving the Problems (1) According to an aspect of the present invention, a driving device that drives a plasma display panel including a plurality of discharge cells at intersections of a plurality of scan electrodes and a plurality of sustain electrodes with a plurality of data electrodes by a sub-field method in which one field period includes a plurality of sub-fields includes a scan electrode driving circuit that drives the plurality of scan electrodes, a sustain electrode driving circuit that drives the plurality of sustain electrodes, and a determiner that determines whether at least one of the plurality of discharge cells lights up or all of the plurality of discharge cells do not light up in each field period, wherein the scan electrode driving circuit applies a first ramp waveform dropping from a first potential to a second potential to the plurality of scan electrodes in a first period within a setup period of each sub-field, applies a scan pulse for write discharge to the plurality of scan electrodes in a write period of each sub-field when the determiner determines that the at least one of the plurality of discharge cells lights up, and does not apply the scan pulse to the plurality of scan electrodes in the write period of each sub-field when the determiner determines that all of the plurality of discharge cells do not light up, the sustain electrode driving circuit applies a second ramp waveform dropping from a third potential to a fourth potential to the plurality of sustain electrodes in a second period, which is shorter than the first period, within the first period when the determiner determines that the at least one of the plurality of discharge cells lights up, and applies a third ramp waveform dropping from the third potential to a fifth potential to the plurality of sustain electrodes in a third period, which is shorter than the first period and longer than the second period, within the first period when the determiner determines that all of the plurality of discharge cells do not light up.

In the driving device, the determiner determines in each field period whether at least one of the plurality of discharge cells lights up or all of the plurality of discharge cells do not light up.

The first ramp waveform dropping from the first potential to the second potential is applied to the plurality of scan electrodes by the scan electrode driving circuit in the first period within the setup period of each sub-field.

When it is determined that the at least one of the plurality of discharge cells lights up, the second ramp waveform dropping from the third potential to the fourth potential is applied to the plurality of sustain electrodes by the sustain electrode driving circuit in the second period, which is shorter than the first period, within the first period. In this case, the potential of the sustain electrodes drops while the potential of the scan electrodes drops in the second period. This suppresses an increase in potential difference between the scan electrodes and the sustain electrodes. As a result, generation of setup discharge is inhibited in the second period.

Thereafter, the scan pulse for the write discharge is applied to the plurality of scan electrodes by the scan electrode driving circuit in the write period of each sub-field. Accordingly, selected discharge cells on each scan electrode light up.

As described above, since the setup discharge is inhibited in the second period to shorten a period of generation of the setup discharge in the first period, light emission of the discharge cells caused by the setup discharge is inhibited. This leads to low black luminance, improving contrast.

On the other hand, when it is determined that all of the plurality of discharge cells do not light up, the third ramp waveform dropping from the third potential to the fifth potential is applied to the plurality of sustain electrodes by the sustain electrode driving circuit in the third period that is shorter than the first period and longer than the second period. In this case, the potential of the sustain electrodes drops while the potential of the scan electrodes drops in the third period. This suppresses the increase in the potential difference between the scan electrodes and the sustain electrodes. As a result, generation of the setup discharge is inhibited in the third period.

Thereafter, the scan pulse for the write discharge is not applied to the plurality of scan electrodes by the scan electrode driving circuit in the write period of each sub-field. In this case, the write discharge is not generated in all the discharge cells.

As described above, since the setup discharge is inhibited in the third period to further shorten the period of generation of the setup discharge in the first period, light emission of the discharge cells caused by the setup discharge is sufficiently inhibited. As a result, the luminance of black displayed on the entire screen is sufficiently decreased.

Moreover, after the third period, the scan pulse is not applied to the plurality of scan electrodes in the write period of each sub-field. Accordingly, an occurrence of erroneous discharge is reliably prevented in the write period even when a large amount of wall charges remains on each discharge cell due to the shortened period of generation of the setup discharge.

As described above, driving waveforms of the scan electrodes and the sustain electrodes are switched depending on a determination result as to whether at least one of the plurality of discharge cells lights up or all of the plurality of discharge cells do not light up in each field period, so that the black luminance when black is displayed on the entire screen can be sufficiently decreased.

(2) The sustain electrode driving circuit may bring the plurality of sustain electrodes into a floating state in the second period when the determiner determines that at least one of the plurality of discharge cells lights up, and bring the plurality of sustain electrodes into the floating state in the third period when the determiner determines that all of the plurality of discharge cells do not light up.

When the sustain electrodes are in the floating state, the potential of each sustain electrode changes according to potential change of the corresponding scan electrode due to capacitive coupling. Thus, the potential of the sustain electrodes changes according to the first ramp waveform applied to the scan electrodes in the second and third periods. Accordingly, the second and third ramp waveforms can be applied to the plurality of sustain electrodes by a simple circuit configuration. As a result, rising cost is avoided.

(3) The scan electrode driving circuit may apply a fourth ramp waveform rising from a sixth potential to a seventh potential to the plurality of scan electrodes for setup discharge in a fourth period, which precedes the first period, within the setup period of the at least one sub-field, and the sustain electrode driving circuit may apply a fifth ramp waveform rising from an eighth potential to a ninth potential to the plurality of sustain electrodes in a fifth period, which is shorter than the fourth period, within the fourth period.

In this case, the fourth ramp waveform rising from the sixth potential to the seventh potential is applied to the plurality of scan electrodes by the scan electrode driving circuit in the fourth period preceding the first period in the at least one sub-field. Thus, the setup discharge is generated twice in the fourth period and the first period within the setup period. As a result, all charges on the plurality of discharge cells are adjusted to be suitable for the write discharge.

In addition, the fifth ramp waveform rising from the eighth potential to the ninth potential is applied to the plurality of sustain electrodes by the sustain electrode driving circuit in the fifth period, which is shorter than the fourth period, within the fourth period. In this case, the potential of the sustain electrodes rises while the potential of the scan electrodes rises in the fifth period. This suppresses an increase in the potential difference between the scan electrodes and the sustain electrodes. As a result, generation of the setup discharge is inhibited in the fifth period.

As described above, since the setup discharge is inhibited in the fifth period to shorten a period of generation of the setup discharge in the fourth period, light emission of the discharge cells caused by the setup discharge is inhibited. This leads to lower black luminance, improving the contrast.

(4) The sustain electrode driving circuit may bring the plurality of sustain electrodes into a floating state in the fifth period.

When the sustain electrodes are in the floating state, the potential of each sustain electrode changes according to potential change of the corresponding scan electrode due to capacitive coupling. Thus, the potential of the sustain electrodes changes according to the fourth ramp waveform applied to the scan electrodes in the fifth period. Accordingly, the fifth ramp waveform can be applied to the plurality of sustain electrodes by a simple circuit configuration. As a result, rising cost is avoided.

(5) According to another aspect of the present invention, a driving method that drives a plasma display panel including a plurality of discharge cells at intersections of a plurality of scan electrodes and a plurality of sustain electrodes with a plurality of data electrodes by a sub-field method in which one field period includes a plurality of sub-fields includes the steps of determining whether at least one of the plurality of discharge cells lights up or all of the plurality of discharge cells do not light up in each field period, applying a first ramp waveform dropping from a first potential to a second potential to the plurality of scan electrodes in a first period within a setup period of each sub-field, applying a second ramp waveform dropping from a third potential to a fourth potential to the plurality of sustain electrodes in a second period, which is shorter than the first period, within the first period, and applying a scan pulse for write discharge to the plurality of scan electrodes in a write period of each sub-field when it is determined that the at least one of the plurality of discharge cells lights up, and applying a third ramp waveform dropping from the third potential to a fifth potential to the plurality of sustain electrodes in a third period, which is shorter than the first period and longer than the second period, within the first period, and not applying the scan pulse to the plurality of scan electrodes in the write period of each field when it is determined that all of the plurality of discharge cells do not light up.

In the driving method, determination as to whether at least one of the plurality of discharge cells lights up or all of the plurality of discharge cells do not light up is made in each field period.

The first ramp waveform dropping from the first potential to the second potential is applied to the plurality of scan electrodes in the first period within the setup period of each sub-field.

When it is determined that the at least one of the plurality of discharge cells lights up, the second ramp waveform dropping from the third potential to the fourth potential is applied to the plurality of sustain electrodes in the second period, which is shorter than the first period, within the first period. In this case, the potential of the sustain electrodes drops while the potential of the scan electrodes drops in the second period. This suppresses an increase in potential difference between the scan electrodes and the sustain electrodes. As a result, generation of the setup discharge is inhibited in the second period.

Thereafter, the scan pulse for the write discharge is applied to the plurality of scan electrodes in the write period of each sub-field. Accordingly, selected discharge cells on each scan electrode light up.

As described above, since the setup discharge is inhibited in the second period to shorten a period of generation of the setup discharge in the first period, light emission of the discharge cells caused by the setup discharge is inhibited. This leads to lower black luminance, improving contrast.

On the other hand, when it is determined that all of the plurality of discharge cells do not light up, the third ramp waveform dropping from the third potential to the fifth potential is applied to the plurality of sustain electrodes in the third period that is shorter than the first period and longer than the second period. In this case, the potential of the sustain electrodes drops while the potential of the scan electrodes drops in the third period. This suppresses an increase in the potential difference between the scan electrodes and the sustain electrodes. As a result, generation of the setup discharge is inhibited in the third period.

Thereafter, the scan pulse for the write discharge is not applied to the plurality of scan electrodes in the write period of each sub-field. In this case, the write discharge is not generated in all the discharge cells.

As described above, since the setup discharge is suppressed in the third period to further shorten the period of generation of the setup discharge in the first period, light emission of the discharge cells caused by the setup discharge is sufficiently inhibited. As a result, black luminance displayed on the entire screen is sufficiently decreased.

Moreover, after the third period, the scan pulse is not applied to the plurality of scan electrodes in the write period of each sub-field. Accordingly, an occurrence of erroneous discharge is reliably prevented in the write period even when a large amount of wall charges remains on each discharge cell due to the shortened period of generation of the setup discharge.

As described above, driving waveforms of the scan electrodes and the sustain electrodes are switched depending on a determination result as to whether at least one of the plurality of discharge cells lights up or all of the plurality of discharge cells do not light up in each field period, so that the black luminance when black is displayed on the entire screen can be sufficiently decreased.

(6) According to still another aspect of the present invention, a plasma display apparatus includes a plasma display panel including a plurality of discharge cells at intersections of a plurality of scan electrodes and a plurality of sustain electrodes with a plurality of data electrodes, and a driving device that drives the plasma display panel by a sub-field method in which one field period includes a plurality of sub-fields, wherein the driving device includes a scan electrode driving circuit that drives the plurality of scan electrodes, a sustain electrode driving circuit that drives the plurality of sustain electrodes, and a determiner that determines whether at least one of the plurality of discharge cells lights up or all of the plurality of discharge cells do not light up in each sub-field period, the scan electrode driving circuit applies a first ramp waveform dropping from a first potential to a second potential to the plurality of scan electrodes in a first period within a setup period of each sub-field, applies a scan pulse for write discharge to the plurality of scan electrodes in a write period of each sub-field when the determiner determines that the at least one of the plurality of discharge cells lights up, and does not apply the scan pulse to the plurality of scan electrodes in the write period of each sub-field when the determiner determines that all of the plurality of discharge cells do not light up, and the sustain electrode driving circuit applies a second ramp waveform dropping from a third potential to a fourth potential to the plurality of sustain electrodes in a second period, which is shorter than the first period, within the first period when the determiner determines that the at least one of the plurality of discharge cells lights up, and applies a third ramp waveform dropping from the third potential to a fifth potential to the plurality of sustain electrodes in a third period, which is shorter than the first period and longer than the second period, within the first period when the determiner determines that all of the plurality of discharge cells do not light up.

In the plasma display apparatus, the driving device drives the plasma display panel including the plurality of discharge cells by the sub-field method in which one field period includes the plurality of sub-fields.

In the driving device, the determiner determines in each field period whether at least one of the plurality of discharge cells lights up or all of the plurality of discharge cells do not light up.

The first ramp waveform dropping from the first potential to the second potential is applied to the plurality of scan electrodes by the scan electrode driving circuit in the first period within the setup period of each sub-field.

When it is determined that the at least one of the plurality of discharge cells lights up, the second ramp waveform dropping from the third potential to the fourth potential is applied to the plurality of sustain electrodes by the sustain electrode driving circuit in the second period, which is shorter than the first period, within the first period. In this case, the potential of the sustain electrodes drops while the potential of the scan electrodes drops in the second period. This suppresses an increase in potential difference between the scan electrodes and the sustain electrodes. As a result, generation of the setup discharge is inhibited in the second period.

Thereafter, the scan pulse for the write discharge is applied to the plurality of scan electrodes by the scan electrode driving circuit in the write period of each sub-field. Accordingly, selected discharge cells on each scan electrode light up.

As described above, since the setup discharge is inhibited in the second period to shorten a period of generation of the setup discharge in the first period, light emission of the discharge cells caused by the setup discharge is inhibited. This leads to lower black luminance, improving contrast.

On the other hand, when it is determined that all of the plurality of discharge cells do not light up, the third ramp waveform dropping from the third potential to the fifth potential is applied to the plurality of sustain electrodes by the sustain electrode driving circuit in the third period that is shorter than the first period and longer than the second period. In this case, the potential of the sustain electrodes drops while the potential of the scan electrodes drops in the third period. This suppresses an increase in the potential difference between the scan electrodes and the sustain electrodes. As a result, generation of the setup discharge is inhibited in the third period.

Thereafter, the scan pulse for the write discharge is not applied to the plurality of scan electrodes by the scan electrode driving circuit in the write period of each sub-field. In this case, the write discharge is not generated in all the discharge cells.

As described above, since the setup discharge is inhibited in the third period to further shorten the period of generation of the setup discharge in the first period, light emission of the discharge cells caused by the setup discharge is sufficiently inhibited. As a result, black luminance displayed on the entire screen is sufficiently decreased.

Moreover, after the third period, the scan pulse is not applied to the plurality of scan electrodes in the write period of each sub-field. Accordingly, an occurrence of erroneous discharge is reliably prevented in the write period even when a large amount of wall charges remains on each discharge cell due to the shortened period of generation of the setup discharge.

As described above, driving waveforms of the scan electrodes and the sustain electrodes are switched depending on a determination result as to whether at least one of the plurality of discharge cells lights up or all of the plurality of discharge cells do not light up in each field period, so that the black luminance when black is displayed on the entire screen can be sufficiently decreased.

(7) According to still another aspect of the present invention, a driving device that drives a plasma display panel including a plurality of discharge cells at intersections of a plurality of scan electrodes and a plurality of sustain electrodes with a plurality of data electrodes by a sub-field method in which one field period includes a plurality of sub-fields includes a scan electrode driving circuit that drives the plurality of scan electrodes, a sustain electrode driving circuit that drives the plurality of sustain electrodes, and a determiner that determines whether at least one of the plurality of discharge cells lights up or all of the plurality of discharge cells do not light up in each field period, wherein the scan electrode driving circuit applies a first ramp waveform dropping from a first potential to a second potential to the plurality of scan electrodes in a first period within a setup period of each sub-field, and does not apply a scan pulse to the plurality of scan electrodes in a write period of each sub-field when the determiner determines that all of the plurality of discharge cells do not light up, and the sustain electrode driving circuit applies a second ramp waveform dropping from a third potential to a fourth potential to the plurality of sustain electrodes in a second period, which is shorter than the first period, within the first period when the determiner determines that all of the plurality of discharge cells do not light up.

In the driving device, the determiner determines in each field period whether at least one of the plurality of discharge cells lights up or all of the plurality of discharge cells do not light up.

The first ramp waveform dropping from the first potential to the second potential is applied to the plurality of scan electrodes by the scan electrode driving circuit in the first period within the setup period of each sub-field.

When it is determined that all of the plurality of discharge cells do not light up, the second ramp waveform dropping from the third potential to the fourth potential is applied to the plurality of sustain electrodes by the sustain electrode driving circuit in the second period that is shorter than the first period. In this case, the potential of the sustain electrodes drops while the potential of the scan electrodes drops in the second period. This suppresses an increase in potential difference between the scan electrodes and the sustain electrodes. As a result, generation of the setup discharge is inhibited in the second period.

Thereafter, the scan pulse for the write discharge is not applied to the plurality of scan electrodes by the scan electrode driving circuit in the write period of each sub-field. In this case, the write discharge is not generated in all the discharge cells.

As described above, since the setup discharge is inhibited in the second period to shorten a period of generation of the setup discharge in the first period, light emission of the discharge cells caused by the setup discharge is inhibited. As a result, black luminance displayed on the entire screen is sufficiently decreased.

Moreover, after the second period, the scan pulse is not applied to the plurality of scan electrodes in the write period of each sub-field. Accordingly, an occurrence of erroneous discharge is reliably prevented in the write period even when a large amount of wall charges remains on each discharge cell due to the shortened period of generation of the setup discharge.

Effects of the Invention

According to the present invention, the driving waveforms of the scan electrodes and the sustain electrodes are switched depending on a determination result as to whether at least one of the plurality of discharge cells lights up or all of the plurality of discharge cells do not light up in each field period. This significantly shortens the period of generation of the setup discharge when black is displayed on the entire screen. Accordingly, light emission of the discharge cells caused by the setup discharge is sufficiently inhibited. As a result, black luminance displayed on the entire screen is sufficiently decreased.

In addition, an occurrence of erroneous discharge is reliably prevented in the write period even when a large amount of wall charges remains on each discharge cell due to the shortened period of generation of the setup discharge.

BEST MODE FOR CARRYING OUT THE INVENTION

Figure 1:
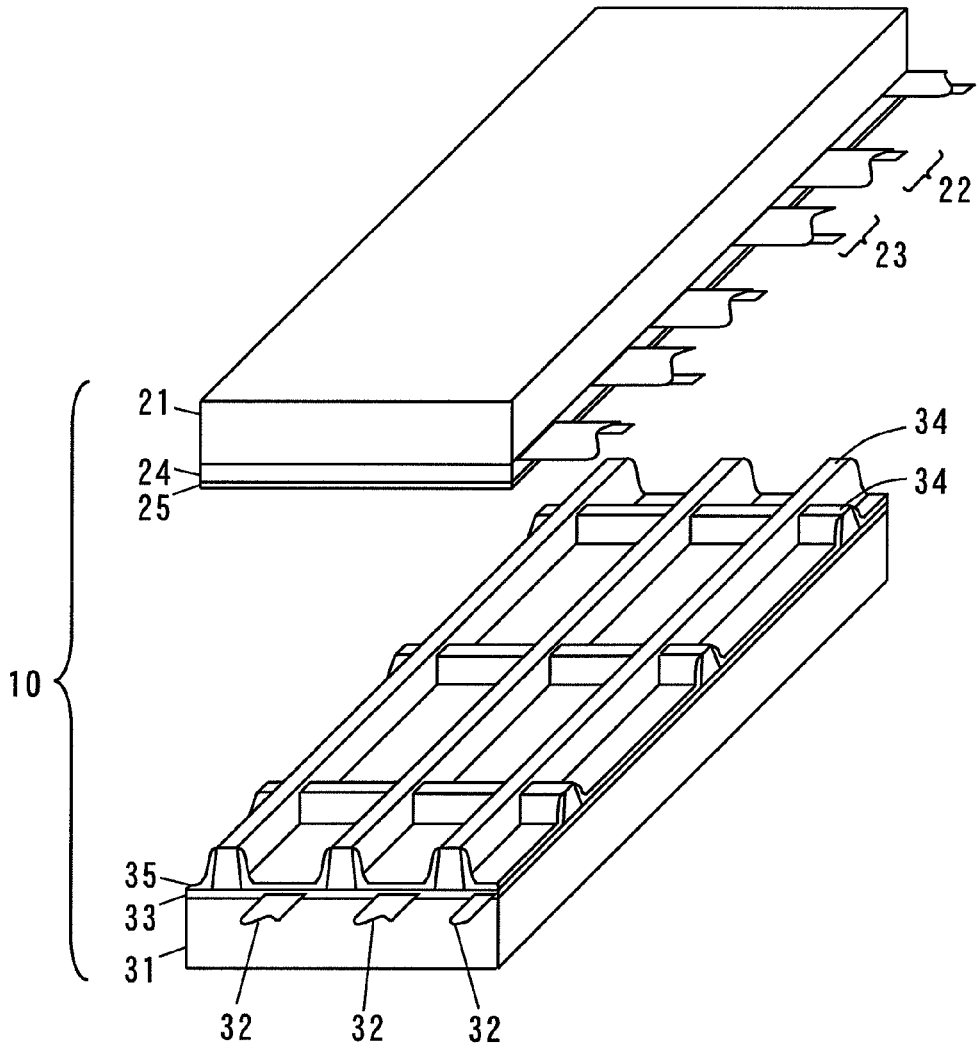
FIG. 1 is an exploded perspective view showing part of a plasma display panel in a plasma display apparatus according to one embodiment of the present invention.

The embodiments of the present invention will be described in detail referring to the drawings. The embodiments below describe a driving device, a driving method of a plasma display panel and a plasma display apparatus.

(1) Configuration of Panel

FIG. 1 is an exploded perspective view showing part of a plasma display panel in a plasma display apparatus according to one embodiment of the present invention.

The plasma display panel (hereinafter abbreviated as the panel) 10 includes a front substrate 21 and a back substrate 31 that are made of glasses and arranged to face each other. A discharge space is formed between the front substrate 21 and the back substrate 31. A plurality of pairs of scan electrodes 22 and sustain electrodes 23 are formed in parallel with one another on the front substrate 21. Each pair of scan electrode 22 and sustain electrode 23 constitutes a display electrode. A dielectric layer 24 is formed to cover the scan electrodes 22 and the sustain electrodes 23, and a protective layer 25 is formed on the dielectric layer 24.

A plurality of data electrodes 32 covered with an insulator layer 33 are provided on the back substrate 31, and barrier ribs 34 are provided in a shape of a number sign on the insulator layer 33. Phosphor layers 35 are provided on a surface of the insulator layer 33 and side surfaces of the barrier ribs 34. Then, the front substrate 21 and the back substrate 31 are arranged to face each other such that the plurality of pairs of scan electrodes 22 and sustain electrodes 23 vertically intersect with the plurality of data electrodes 32, and the discharge space is formed between the front substrate 21 and the back substrate 31. The discharge space is filled with a mixed gas of neon and xenon, for example, as a discharge gas. Note that the configuration of the panel is not limited to the configuration described in the foregoing. A configuration including the barrier ribs in a striped shape may be employed, for example.

The above-mentioned phosphor layers 35 include R (red), G (green) and B (blue) phosphor layers, any of which is provided in each discharge cell. One pixel on the panel 10 is constituted by three discharge cells including phosphors of R, G and B, respectively.

Figure 2:
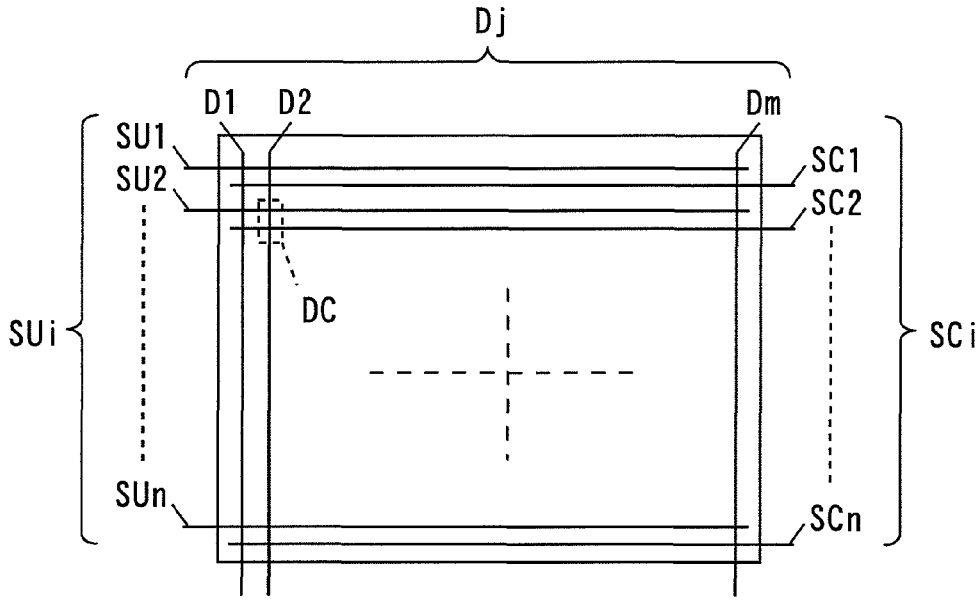
FIG. 2 is a diagram showing an arrangement of electrodes of the panel in the one embodiment of the present invention.

FIG. 2 is a diagram showing an arrangement of the electrodes of the panel in the one embodiment of the present invention. N scan electrodes SC1 to SCn (the scan electrodes 22 of FIG. 1) and n sustain electrodes SU1 to SUn (the sustain electrodes 23 of FIG. 1) are arranged along a row direction, and m data electrodes D1 to Dm (the data electrodes 32 of FIG. 1) are arranged along a column direction. Each of n and m is a natural number of not less than two. Then, a discharge cell DC is formed at an intersection of a pair of scan electrode SCi and sustain electrode SUi with one data electrode Dj.

Accordingly, m×n discharge cells are formed in the discharge space. Note that i is an arbitrary integer of 1 to n, and j is an arbitrary integer of 1 to m.

(2) Configuration of the Plasma Display Apparatus

Figure 3:
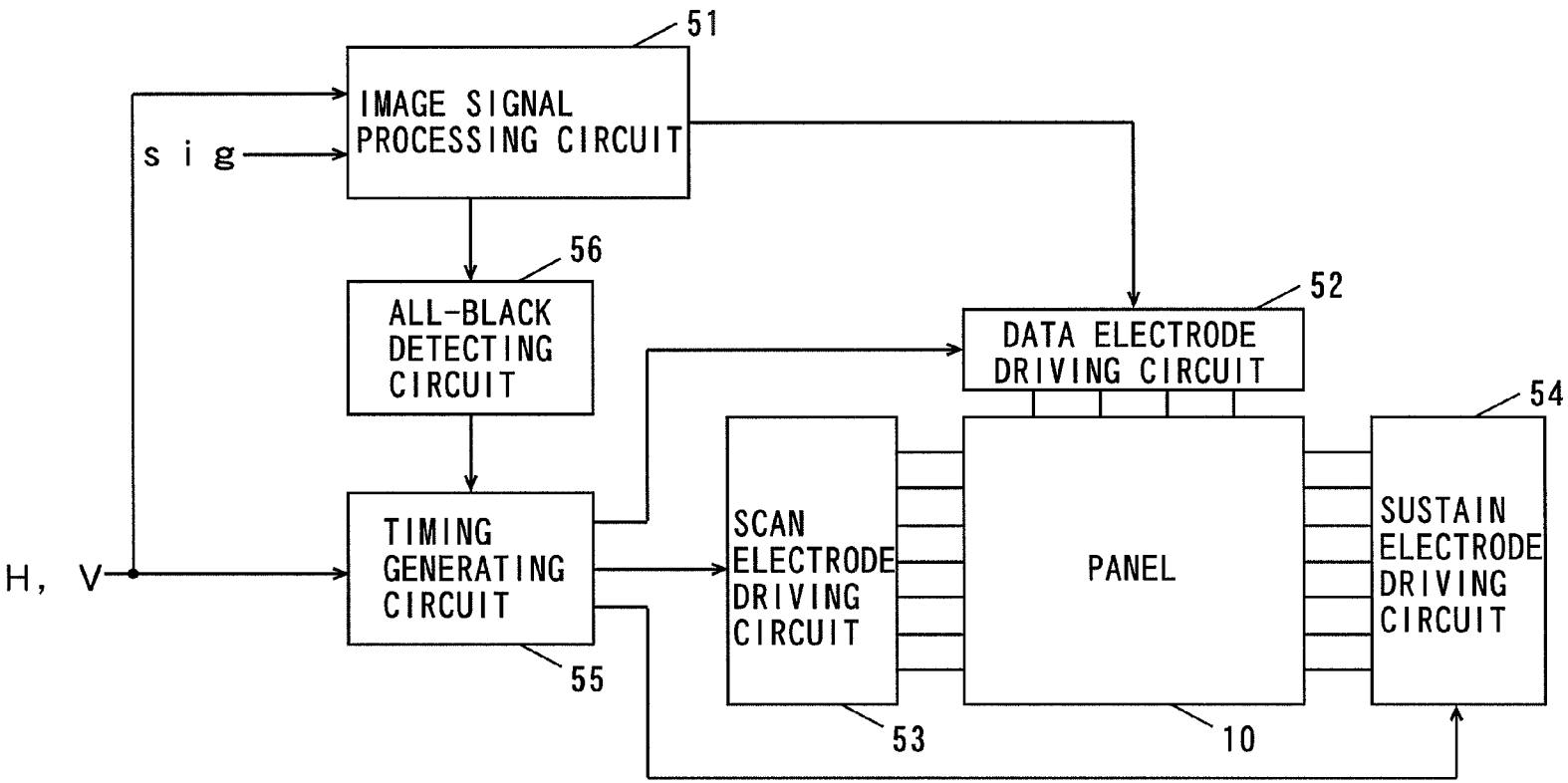
FIG. 3 is a block diagram of circuits in the plasma display apparatus according to the one embodiment of the present invention.

FIG. 3 is a block diagram of circuits in the plasma display apparatus according to the one embodiment of the present invention.

The plasma display apparatus includes the panel 10, an image signal processing circuit 51, a data electrode driving circuit 52, a scan electrode driving circuit 53, a sustain electrode driving circuit 54, a timing generating circuit 55, an all-black detecting circuit 56 and a power supply circuit (not shown).

The image signal processing circuit 51 converts an image signal sig into image data corresponding to the number of pixels of the panel 10, divides the image data on each pixel into a plurality of bits corresponding to a plurality of sub-fields, and outputs them to the data electrode driving circuit 52 and the all-black detecting circuit 56.

The data electrode driving circuit 52 converts the image data for each sub-field into signals corresponding to the data electrodes D1 to Dm, respectively, and drives the data electrodes D1 to Dm based on the respective signals.

The all-black detecting circuit 56 determines based on the image data for each sub-field whether or not all the pixels of the panel 10 display black, and supplies a result of the determination to the timing generating circuit 55. In the following description, a state in which all the pixels of the panel 10 display black is referred to as "all-black".

Specifically, the all-black detecting circuit 56 detects lighting rates of the discharge cells DC for each sub-field, and determines that a display state of the panel 10 is "all-black" when the lighting rates are zero throughout one field period. Here, the lighting rate is defined by the following equation.

The lighting rate=the number of discharge cells that simultaneously light up (emit light)/the number of all the discharge cells of the panel.

The timing generating circuit 55 generates timing signals based on the determination result supplied from the all-black detecting circuit 56, a horizontal synchronizing signal H and a vertical synchronizing signal V, and supplies the timing signals to each of the driving circuit blocks (the image signal processing circuit 51, the data electrode driving circuit 52, the scan electrode driving circuit 53 and the sustain electrode driving circuit 54).

The scan electrode driving circuit 53 supplies driving waveforms to the scan electrodes SC1 to SCn based on the timing signals, and the sustain electrode driving circuit 54 supplies driving waveforms to the sustain electrodes SU1 to SUn based on the timing signals.

In the present embodiment, the scan electrode driving circuit 53 and the sustain electrode driving circuit 54 switch the driving waveforms when the display state of the panel 10 is not "all-black" and when the display state of the panel 10 is "all-black", and supply the different driving waveforms to the scan electrodes SC1 to SCn and the sustain electrodes SU1 to SUn. Details will be described below.

(3) Driving Methods of the Panel

The panel 10 is driven by the first driving method when the display state is not "all-black", and driven by the second driving method when the display state is "all-black".

Hereinafter, a state in which the sustain electrodes SU1 to SUn are separated from a power supply terminal, a ground terminal and a node (a floating state) is referred to as a high impedance state. In the high impedance state, the sustain electrodes SU1 to SUn are capacitively coupled with the scan electrodes SC1 to SCn. Thus, the potential of the sustain electrodes SU1 to SUn changes according to potential change of the scan electrodes SC1 to SCn. In addition, luminance of a pixel that displays black is referred to as black luminance.

(3-1) The First Driving Method

Figure 4:
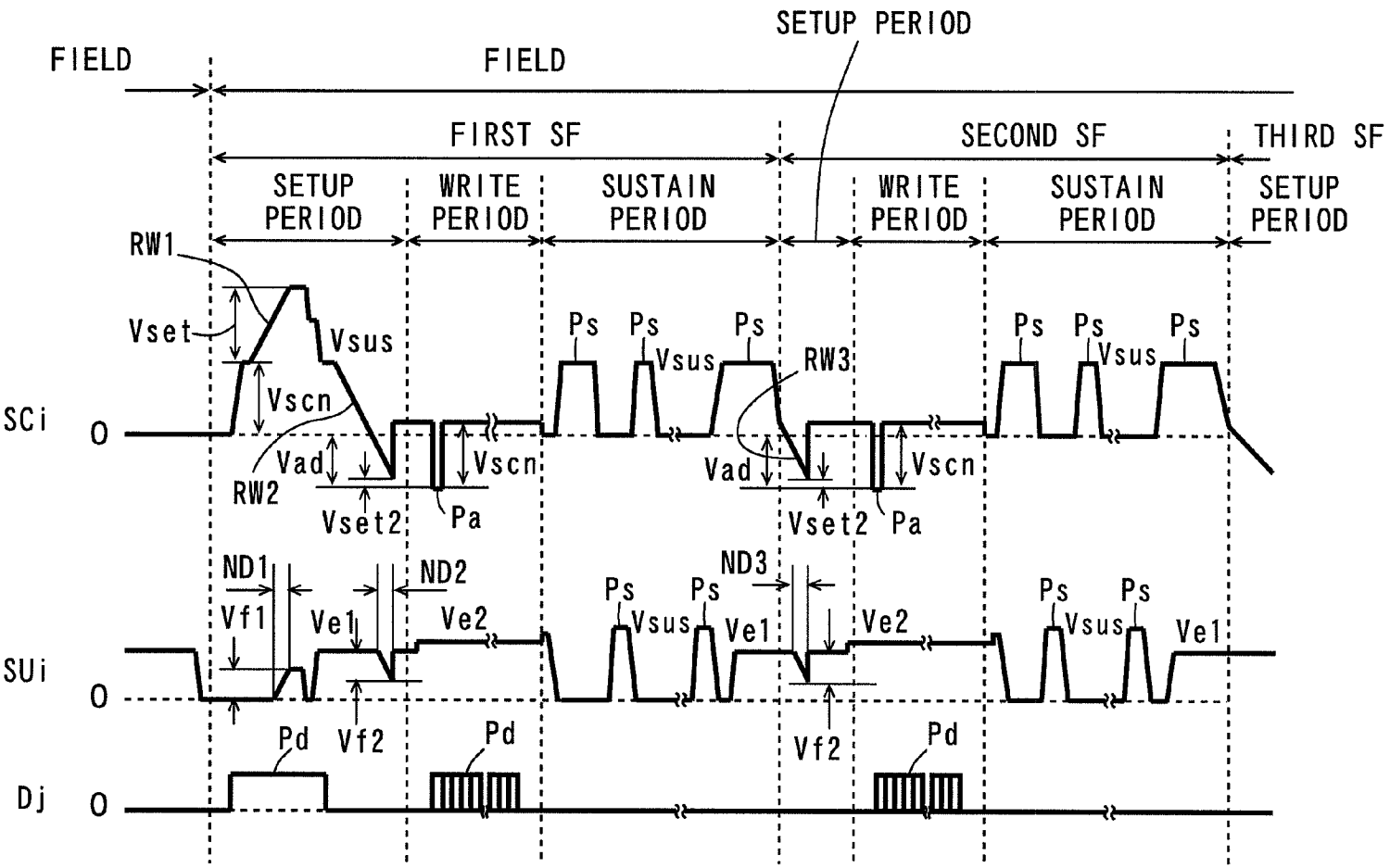
FIG. 4 is a diagram showing one example of driving waveforms applied to respective electrodes of the plasma display apparatus by a first driving method.
Figure 5:
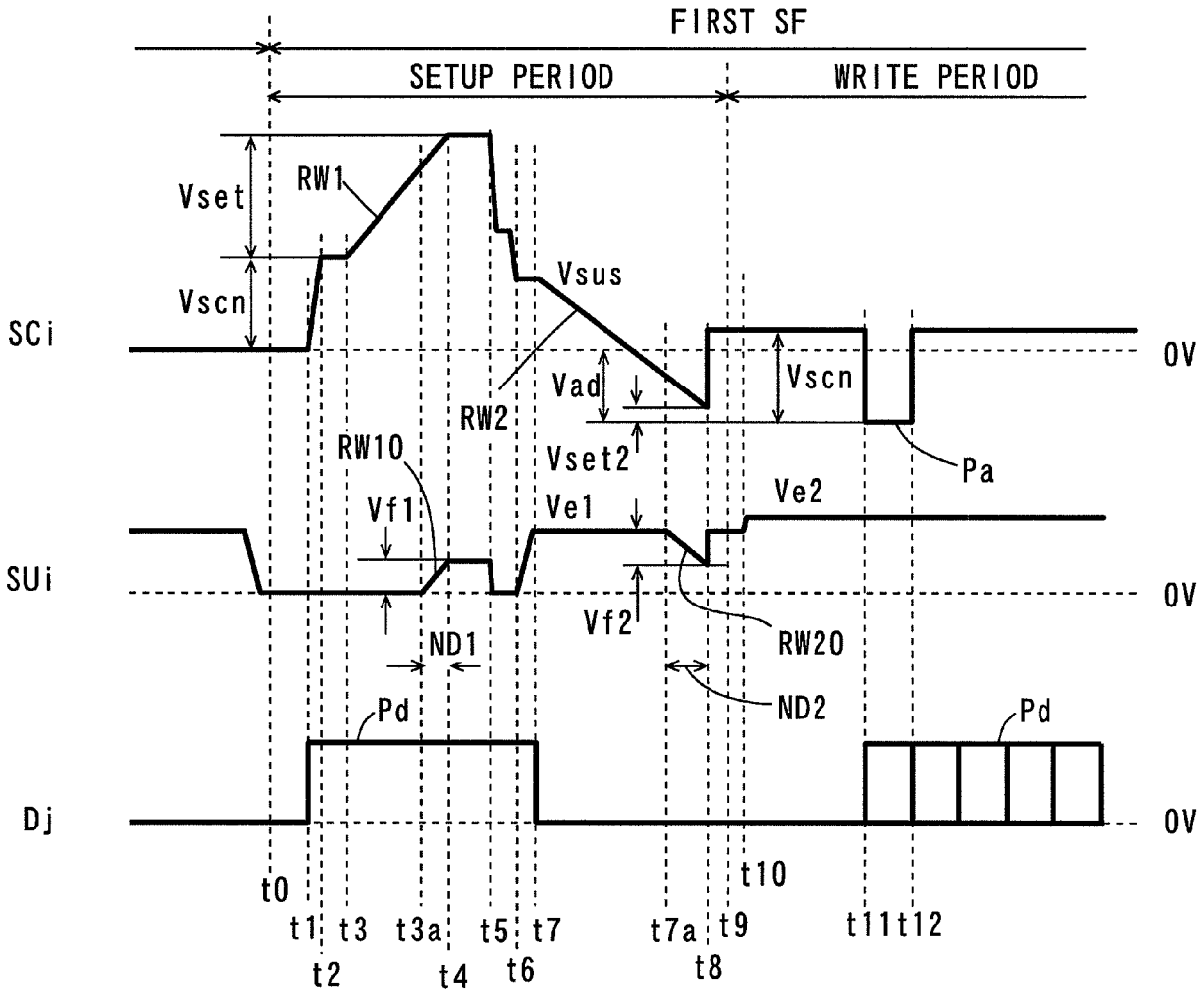
FIG. 5 is a partially enlarged view of the driving waveforms of FIG. 4.

Description is made of the first driving method. FIG. 4 is a diagram showing one example of the driving waveforms applied to the respective electrodes of the plasma display apparatus by the first driving method. FIG. 5 is a partially enlarged view of the driving waveforms of FIG. 4.

FIGS. 4 and 5 each show the driving waveforms of one scan electrode SCi, the driving waveforms of one sustain electrode SUi, and one data electrode Dj. Note that i is an arbitrary integer of 1 to n, and j is an arbitrary integer of 1 to m, as described above. Driving waveforms of other scan electrodes are the same as that of the scan electrode SCi except for timings of scan pulses. Driving waveforms of other sustain electrodes are the same as that of the sustain electrode SUi. Driving waveforms of other data electrodes are the same as that of the data electrode Dj except for states of write pulses.

In the present embodiment, each field is divided into a plurality of sub-fields each having a setup period, a write period and a sustain period. For example, one field is divided into ten sub-fields (hereinafter abbreviated as a first SF, a second SF, . . . , and a tenth SF) on the time base, and the sub-fields have the luminance weights of 0.5, 1, 2, 3, 6, 9, 15, 22, 30 and 40, respectively.

FIG. 4 shows the driving waveforms in a period from a starting time point of the first SF to a setup period of the third SF of one field. FIG. 5 shows the driving waveforms in a period from a setup period to a write period of the first SF of FIG. 4.

In the following description, a voltage caused by wall charges stored on the dielectric layer, the phosphor layers and so on covering the electrode is referred to as a wall voltage on the electrode. The first half of the setup period of the first SF, that is, a period from a time point t3 to a time point t4 of FIG. 5 is referred to as a rise period, and the second half of the setup period of the first SF, that is, a period from a time point t7 to a time point t8 of FIG. 5 is referred to as a drop period.

First, description is made of details of the setup period and the write period of the first SF referring to FIG. 5.

As shown in FIG. 5, the scan electrode SCi, the sustain electrode SUi and the data electrode Dj are held at 0 V (a ground potential) at a starting time point t0 of the first SF.

At a time point t1, the potential of the data electrode Dj rises to a positive potential Pd, and the potential of the scan electrode SCi rises to a positive potential Vscn in a period from the time point t1 to a time point t2.

A positive ramp waveform RW1 for the setup discharge is applied to the scan electrode SCi in a period from the time point t3 to the time point t4. The ramp waveform RW1 gradually rises from the positive potential Vscn toward a positive potential (Vscn+Vset).

This causes a voltage between the scan electrode SCi and the sustain electrode SUi to exceed a discharge start voltage in a period from the time point t3 to a time point t3*a*. As a result, a weak discharge (setup discharge) is generated between the scan electrode SCi and the sustain electrode SUi. Then, the weak discharge (setup discharge) is also generated between the scan electrode SCi and the data electrode Dj.

Here, the sustain electrode SUi is brought into the high impedance state in a period from the time point t3*a* to the time point t4 (a first non-discharge period ND1). Thus, the potential of the sustain electrode SUi changes according to potential change of the scan electrode SCi, and the voltage between the scan electrode SCi and the sustain electrode SUi is maintained constant. In this example, the potential of the sustain electrode SUi gradually rises from the ground potential by a voltage Vf1 (a ramp waveform RW10) in the period from the time point t3*a* to the time point t4. Accordingly, the weak discharge is not generated between the scan electrode SCi and the sustain electrode SUi in a period from the time point t3*a* to a time point t5.

On the other hand, the voltage between the scan electrode SCi and the data electrode Dj exceeds the discharge start voltage, so that the weak discharge is generated between the scan electrode SCi and the data electrode Dj.

In this manner, the negative wall charges are stored on the scan electrode SCi, and the positive wall charges are stored on the sustain electrode SUi during the rise period.

At the time point t5, the high impedance state of the sustain electrode SUi is released, and the potential of the sustain electrode SUi drops to the ground potential.

Then, the potential of the scan electrode SCi drops from the positive potential (Vscn+Vset) to a positive potential Vsus in a period from the time point t5 to a time point t6.

The potential of the sustain electrode SUi rises to a positive potential Ve1 in a period from the time point t6 to the time point t7, and the potential of the data electrode Dj drops to the ground potential at the time point t7.

Then, a negative ramp waveform RW2 is applied to the scan electrode SCi in a period from the time point t7 to the time point t8. The ramp waveform RW2 gradually drops from the positive potential Vsus to a negative potential (−Vad).

This causes the voltage between the scan electrode SCi and the sustain electrode SUi to exceed the discharge start voltage in a period from the time point t7 to a time point t7*a*. As a result, the weak discharge (setup discharge) is generated between the scan electrode SCi and the sustain electrode SUi. After that, the weak discharge (setup discharge) is also generated between the scan electrode SCi and the data electrode Dj.

Here, the sustain electrode SUi is brought into the high impedance state in a period from the time point t7*a* to the time point t8 (a second non-discharge period ND2). Thus, the potential of the sustain electrode SUi changes according to the potential change of the scan electrode SCi, and the voltage between the scan electrode SCi and the sutain electrode SUi is maintained constant. In this example, the potential of the sustain electrode SUi gradually drops from the positive potential Ve1 by a voltage Vf2 (a ramp waveform RW20) in the period from the time point t7*a* to the time point t8. Accordingly, the weak discharge is not generated between the scan electrode SCi and the sustain electrode SUi in the period from the time point t7*a* to the time point t8.

On the other hand, the voltage between the scan electrode SCi and the data electrode Dj exceeds the discharge start voltage, so that the weak discharge is generated between the scan electrode SCi and the data electrode Dj.

In this manner, the negative wall charges stored on the scan electrode SCi decrease and the positive wall charges stored on the sustain electrode SUi decrease during the drop period.

At the time point t8, the potential of the scan electrode SCi rises to a potential (Vscn−Vad). Moreover, the high impedance state of the sustain electrode SUi is released, and the potential of the sustain electrode SUi rises to the positive potential Ve1.

Then, the setup period in the first SF is finished, and the wall voltage on the scan electrode SCi, the wall voltage on the sustain electrode SUi and the wall voltage on the data electrode Dj are adjusted to respective values suitable for a write operation. Specifically, a small amount of negative wall charges are stored on each of the scan electrode SCi and the sustain electrode SUi, and the positive wall charges are stored on the data electrode Dj.

As described above, the setup operation for all cells in which the setup discharges are generated in all the discharge cells DC is performed in the setup period of the first SF.

In the subsequent write period, the potential of the scan electrode SCi is held at the potential (Vscn−Vad), and the potential of the sustain electrode SUi rises to a positive potential Ve2 at a time point t10.

Next, a negative scan pulse Pa (−Vad) is applied to the scan electrode SCi (i=1) on the first row, and a positive write pulse Pd is applied to the data electrode Dk (k is any of 1 to m) of the discharge cell DC that should emit light on the first row at a time point t11.

Then, a voltage at an intersection of the data electrode Dk and the scan electrode SCi attains a value obtained by adding the wall voltage on the scan electrode SCi and the wall voltage on the data electrode Dk to an externally applied voltage (Pd−Pa), exceeding the discharge start voltage. This generates write discharges between the data electrode Dk and the scan electrode SCi and between the sustain electrode SUi and the scan electrode SCi.

As a result, in the discharge cell DC, the positive wall charges are stored on the scan electrode SCi, the negative wall charges are stored on the sustain electrode SUi, and the negative wall charges are stored on the data electrode Dk.

In this manner, the write operation in which the write discharge is generated in the discharge cell DC that should emit light on the first row is performed. Meanwhile, since a voltage at an intersection of a data electrode Dh (h≠k) to which the write pulse has not been applied and the scan electrode SCi does not exceed the discharge start voltage, the write discharge is not generated in the discharge cell DC at the intersection. The above-described write operation is sequentially performed in the discharge cells DC on the first row to the n-th row, and the write period is then finished.

As shown in FIG. 4, in a subsequent sustain period, the potential of the sustain electrode SUi is returned to the ground potential, and the first sustain pulse Ps (=Vsus) is applied to the scan electrode SCi. At this time, the voltage between the scan electrode SCi and the sustain electrode SUi attains a value obtained by adding the wall voltage on the scan electrode SCi and the wall voltage on the sustain electrode SUi to the sustain pulse Ps (=Vsus), exceeding the discharge start voltage in the discharge cell DC in which the write discharge has been generated in the write period.

This induces a sustain discharge between the scan electrode SCi and the sustain electrode SUi, causing the discharge cell DC to emit light. As a result, the negative wall charges are stored on the scan electrode SCi, the positive wall charges are stored on the sustain electrode SUi, and the positive wall charges are stored on the data electrode Dj. In the discharge cell DC in which the write discharge has not been generated in the write period, the sustain discharge is not induced and the wall charges are held in a state at the end of the setup period.

Then, the potential of the scan electrode SCi is returned to the ground potential, and the sustain pulse Ps is applied to the sustain electrode SUi. Since the voltage between the sustain electrode SUi and the scan electrode SCi exceeds the discharge start voltage in the discharge cell DC in which the sustain discharge has been induced, the sustain discharge is again induced between the sustain electrode SUi and the scan electrode SCi, causing the negative wall charges to be stored on the sustain electrode SUi and the positive wall charges to be stored on the scan electrode SCi.

Similarly to this, a predetermined number of sustain pulses Ps are alternately applied to the scan electrode SCi and the sustain electrode SUi, so that the sustain discharges are continuously performed in the discharge cell DC in which the write discharge has been generated in the write period.

Before the sustain period is finished, the potential of the sustain electrode SUi attains the positive potential Ve1 after a predetermined period of time has elapsed since the application of the sustain pulse Ps to the scan electrode SCi. This induces the weak discharge (erase discharge) between the scan electrode SCi and the sustain electrode SUi.

In a setup period of the second SF, a ramp waveform RW3 gradually dropping from the positive potential Vsus toward the negative potential (−Vad) is applied to the scan electrode SCi while the sustain electrode SUi is held at the positive potential Ve1 and the data electrode Dj is held at the ground potential. Then, the weak discharge (setup discharge) is generated in the discharge cell DC in which the sustain discharge has been induced in the sustain period of the preceding sub-field.

Here, also in the setup period of the second SF, the sustain electrode SUi is brought into the high impedance state for a predetermined period of time (a third non-discharge period ND3) in the second half of a period of application of the ramp waveform RW3 to the scan electrode SCi. Accordingly, the potential of the sustain electrode SUi changes according to the potential change of the scan electrode SCi, and the voltage between the scan electrode SCi and the sustain electrode SUi is maintained constant. In this example, the potential of the sustain electrode SUi gradually drops from the positive potential Ve1 by the voltage Vf2. Thus, the weak discharge is not generated between the scan electrode SCi and the sustain electrode SUi in the predetermined period of time in the second half of the setup period of the second SF.

In this manner, the wall voltage on the scan electrode SCi and the wall voltage on the sustain electrode SUi are weakened, and the wall voltage on the data electrode Dj is adjusted to a value suitable for the write operation. As described above, a selective setup operation in which the setup discharge is selectively generated in the discharge cell DC in which the sustain discharge has been generated in the immediately preceding sub-field is performed in the setup period of the second SF.

In a write period of the second SF, the write operation is sequentially performed in the discharge cells on the first row to the n-th row similarly to the write period of the first SF, and the write period is then finished. Since an operation in the subsequent sustain period is the same as that in the sustain period of the first SF except for the number of the sustain pulses, explanation is omitted.

In setup periods of the subsequent third to tenth SFs, the selective setup operations are performed similarly to the setup period of the second SF. In write periods of the third to tenth SFs, the sustain electrode SUi is held at the potential Ve2 similarly to the second SF to perform the write operations. In sustain periods of the third to tenth SFs, the same sustain operations as that in the sustain period of the first SF except for the number of the sustain pulses are performed.

(3-2) The Second Driving Method

Figure 6:
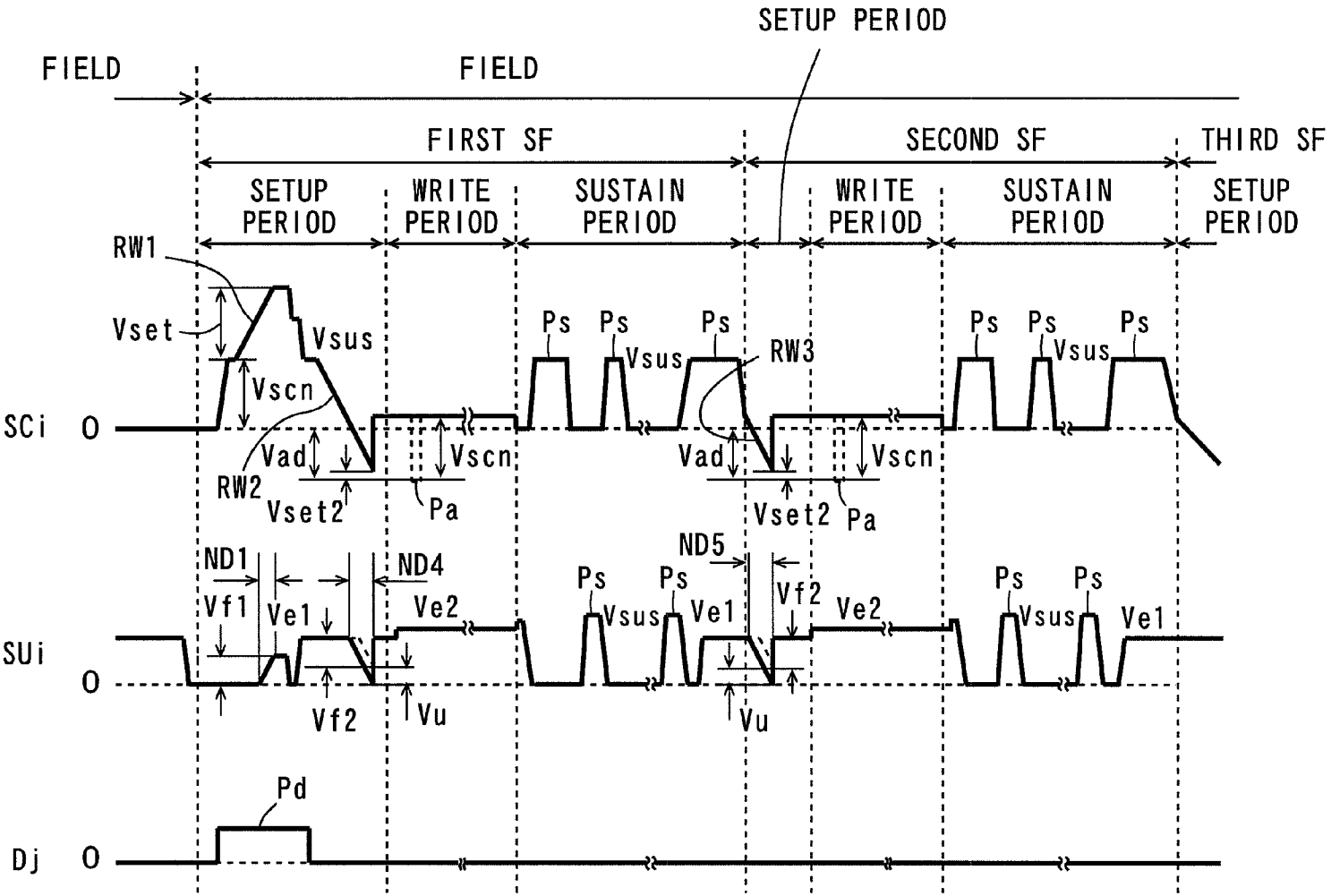
FIG. 6 is a diagram showing one example of driving waveforms applied to the respective electrodes of the plasma display apparatus by a second driving method.
Figure 7:
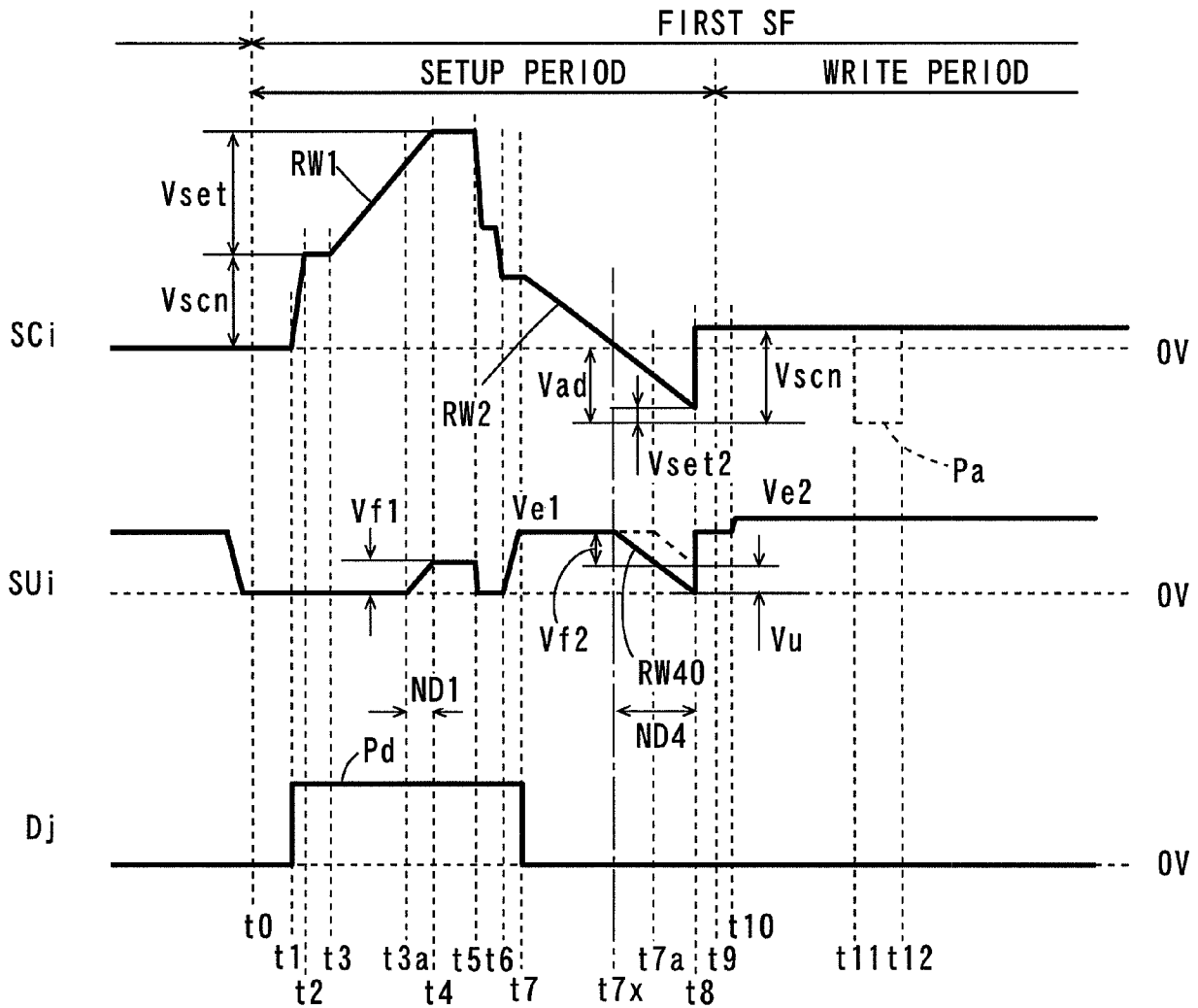
FIG. 7 is a partially enlarged view of the driving waveforms of FIG. 6.

Description is made of the second driving method while referring to differences from the first driving method. FIG. 6 is a diagram showing one example of the driving waveforms applied to the respective electrodes of the plasma display apparatus by the second driving method. FIG. 7 is a partially enlarged view of the driving waveforms of FIG. 6.

Similarly to FIGS. 4 and 5, FIG. 6 shows the driving waveforms in the period from the starting time point of the first SF to the setup period of the third SF of the one field. FIG. 7 shows the driving waveforms in the period from the setup period to the write period of the first SF of FIG. 6. Description is made of details of the setup period and the write period of the first SF referring to FIG. 7.

Note that the panel 10 is driven by the second driving method in the case of "all-black", as described above. When the display state of the panel 10 is "all-black", the write pulse is not applied to the data electrodes D1 to Dm.

As shown in FIG. 7, in the second driving method, a period in which the sustain electrode SUi is in the high impedance state during the drop period is different from that in the first driving method.

Specifically, the sustain electrode SUi is in the high impedance state in a period from a time point t7*x*, which is earlier than the time point t7*a*, to the time point t8 (a fourth non-discharge period ND4) as shown in FIG. 7.

As described above, when the sustain electrode SUi is in the high impedance state, the potential of the sustain electrode SUi changes according to the potential change of the scan electrode SCi, and the voltage between the scan electrode SCi and the sustain electrode SUi is maintained constant. In this example, the potential of the sustain electrode SUi gradually drops from the positive potential Ve1 by a voltage (Vf2+Vu) (a ramp waveform RW40) in the period from the time point t7*x* to the time point t8. Accordingly, the weak discharge is not generated between the scan electrode SCi and the sustain electrode SUi in the period from the time point t7*x* to the time point t8. Note that the voltage Vu is larger than zero and not more than a voltage (Ve1−Vf2).

Meanwhile, the voltage between the scan electrode SCi and the data electrode Dj exceeds the discharge start voltage to generate the weak discharge between the scan electrode SCi and the data electrode Dj.

As described above, in the second driving method, the period in which the sustain electrode SUi is in the high impedance state (the fourth non-discharge period ND4) during the drop period is longer than that in the first driving period. This significantly shortens a period of generation of the weak discharge between the scan electrode SCi and the sustain electrode SUi.

In this case, the negative wall charges stored on the scan electrode SCi hardly decreases in the period from the time point t7 to the time point t8. Accordingly, a large amount of negative wall charges remains on the scan electrode SCi, and a large amount of positive wall charges remains on the sustain electrode SUi at the time point t8.

Therefore, the write discharge is generated by the large amount of negative wall charges stored on the scan electrode SCi in some cases when the scan pulse Pa is applied to the scan electrode SCi while the write pulse Pd is not applied to the data electrode Dj in the write period.

Therefore, the scan pulse Pa is not applied to the scan electrode SCi during in write period in the second driving method. This reliably prevents the write discharge from being generated between the scan electrode SCi and the data electrode Dj when the write pulse Pd is not applied to the data electrode Dj.

As shown in FIG. 6, the selective setup operation is performed in the setup period of the subsequent second SF. Then, the write operation is performed after the setup period.

Also in the setup period of the second SF, a period in which the sustain electrode SUi is in the high impedance state (a fifth non-discharge period ND5) is longer than that in the first driving method. This significantly shortens a period of generation of the weak discharge between the scan electrode SCi and the sustain electrode SUi.

In addition, the scan pulse Pa is not applied to the scan electrode SCi in the write period. This reliably prevents the write discharge from being generated between the scan electrode SCi and the data electrode Dj while the write pulse Pd is not applied to the data electrode Dj.

(3-3) Effects

The first and second driving methods are switched when the display state of the panel 10 is not "all-black" and when the display state of the panel 10 is "all-black" to be used. Driving the panel 10 by the first and second driving methods provides the following effects.

As described above, the sustain electrode SUi is in the high impedance state in the period from the time point t3*a* to the time point t4 (the first non-discharge period ND1) in the rise period in the first driving method. In addition, the sustain electrode SUi is in the high impedance state in the period from the time point t7*a* to the time point t8 (the second non-discharge period ND2) in the drop period.

The weak discharge is not generated between the scan electrode SCi and the sustain electrode SUi when the sustain electrode SUi is in the high impedance state. The period of generation of the weak discharge is shortened, thus lowering the light emission luminance of the discharge cell DC that does not light up. This results in the lower black luminance.

In the second driving method, the fourth non-discharge period ND4 in the drop period is longer than the second non-discharge period ND2 in the drop period in the first driving method.

In other words, the timing at which the sustain electrode SUi is brought into the high impedance state in the drop period when the display state of the panel 10 is "all-black" is earlier than that when the display state of the panel 10 is not "all-black".

Thus, according to the second driving method, the period of generation of the weak discharge between the scan electrode SCi and the data electrode Dj is significantly shortened, and the light emission of the discharge cell DC caused by the weak discharge is sufficiently inhibited. As a result, the luminance of the panel 10 in the display state of "all-black" can be sufficiently lowered.

Figure 8:
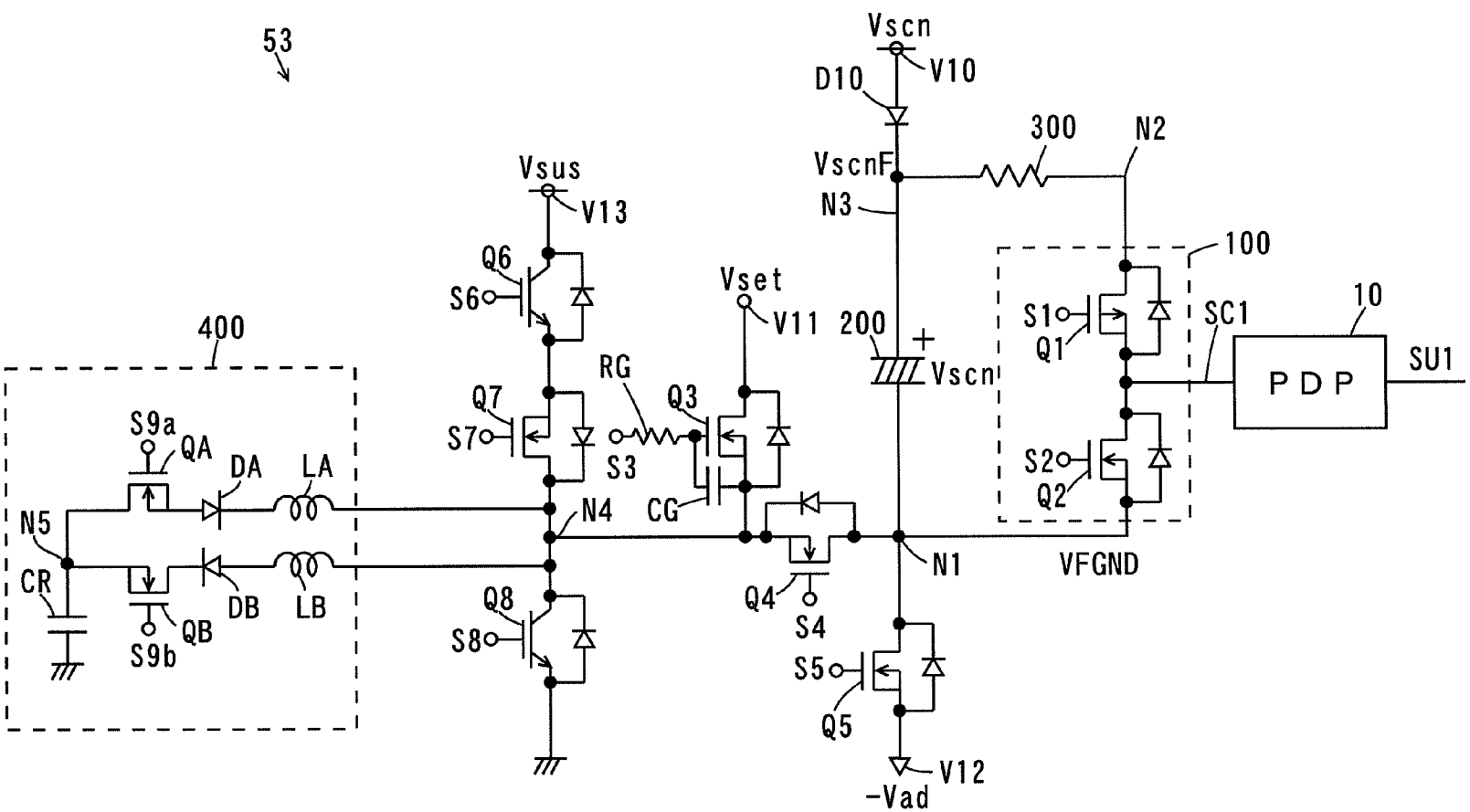
FIG. 8 is a circuit diagram showing the configuration of a scan electrode driving circuit of FIG. 3.

(4) Circuit Configuration and Operation of the Scan Electrode Driving Circuit (4-1) Circuit Configuration FIG. 8 is a circuit diagram showing the configuration of the scan electrode driving circuit 53 of FIG. 3.

The scan electrode driving circuit 53 includes a scan IC (Integrated Circuit) 100, a DC power supply 200, a protective resistor 300, a recovery circuit 400, a diode D10, n-channel field effect transistors (hereinafter abbreviated as transistors) Q3 to Q5, Q7 and NPN bipolar transistors (hereinafter abbreviated as transistors) Q6, Q8. One scan IC 100 connected to the one scan electrode SC1 in the scan electrode driving circuit 53 is shown in FIG. 8. The scan ICs that are the same as the scan IC 100 of FIG. 8 are connected to the other scan electrodes SC2 to SCn, respectively.

The scan IC 100 includes a p-channel field effect transistor (hereinafter abbreviated as a transistor) Q1 and an n-channel field effect transistor (hereinafter abbreviated as a transistor) Q2. The recovery circuit 400 includes n-channel field effect transistors (hereinafter abbreviated as transistors) QA, QB, recovery coils LA, LB, a recovery capacitor CR and diodes DA, DB.

The scan IC 100 is connected between a node N1 and a node N2. The transistor Q1 of the scan IC 100 is connected between the node N2 and the scan electrode SC1, and the transistor Q2 is connected between the scan electrode SC1 and the node N1. A control signal S1 is applied to a gate of the transistor Q1, and a control signal S2 is applied to a gate of the transistor Q2.

The protective resistor 300 is connected between the node N2 and a node N3. A power supply terminal V10 that receives the voltage Vscn is connected to the node N3 through the diode D10. The DC power supply 200 is connected between the node N1 and the node N3. The DC power supply 200 is composed of an electrolytic capacitor, and functions as a floating power supply that holds the voltage Vscn. Hereinafter, a potential of the node N1 is referred to as VFGND, and a potential of the node N3 is referred to as VscnF. The potential VscnF of the node N3 has a value obtained by adding the voltage Vscn to the potential VFGND of the node N1. That is, VscnF=VFGND+Vscn.

The transistor Q3 is connected between a power supply terminal V11 that receives the voltage Vset and a node N4, and a control signal S3 is supplied to a gate. The transistor Q4 is connected between the node N1 and the node N4, and a control signal S4 is supplied to a gate. The transistor Q5 is connected between the node N1 and a power supply terminal V12 that receives the negative voltage (−Vad), and a control signal S5 is applied to a gate. The control signal S4 is an inverted signal of the control signal S5.

The transistors Q6, Q7 are connected between a power supply terminal V13 that receives the voltage Vsus and the node N4. A control signal S6 is supplied to a base of the transistor Q6, and a control signal S7 is supplied to a gate of the transistor Q7. The transistor Q8 is connected between the node N4 and a ground terminal, and a control signal S8 is supplied to a base.

Between the node N4 and a node N5, the recovery coil LA, the diode DA and the transistor QA are connected in series, and the recovery coil LB, the diode DB and the transistor QB are connected in series. A control signal S9*a* is supplied to a gate of the transistor QA, and a control signal S9*b* is supplied to a gate of the transistor QB. The recovery capacitor CR is connected between the node N5 and the ground terminal.

A gate resistor RG and a capacitor CG are connected to the transistor Q3 as shown in FIG. 8. Gate resistors and capacitors, not shown, are connected to the other transistors Q5, Q6, respectively.

The foregoing control signals S1 to S8, S9*a*, S9*b* are supplied from the timing generating circuit 55 of FIG. 3 to the scan electrode driving circuit 53 as the timing signals.

(4-2) Operation in the Setup Period and the Write Period

Figure 9:
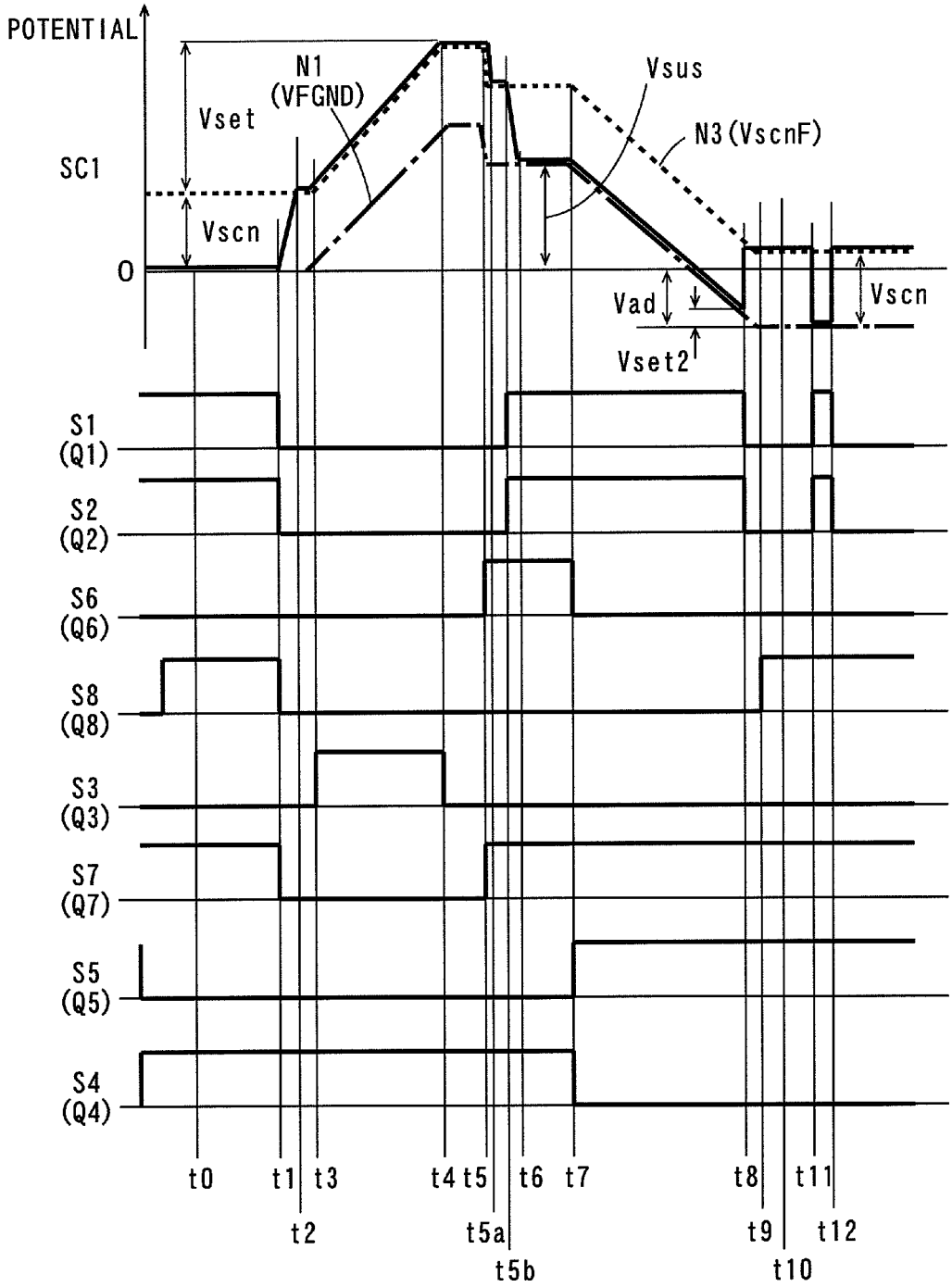
FIG. 9 is a detailed timing chart of control signals supplied to the scan electrode driving circuit in a setup period and a write period of a first SF of FIGS. 4 and 5.

First, description is made of the operation of the scan electrode driving circuit 53 performed based on the first driving method. FIG. 9 is a detailed timing chart of the control signals supplied to the scan electrode driving circuit 53 in the setup period and the write period of the first SF of FIGS. 4 and 5.

Change in the potential VFGND of the node N1 is indicated by the one-dot and dash line, the potential VscnF of the node N3 is indicated by the dotted line, and change in the potential of the scan electrode SC1 is indicated by the solid line in the top stage of FIG. 9. Note that the control signals S9*a*, S9*b* supplied to the recovery circuit 400 are not shown in FIG. 9.

At the starting time point t0 of the first SF, the control signals S6, S3, S5 are at a low level, and the control signals S1, S2, S8, S7, S4 are at a high level. This causes the transistors Q1, Q6, Q3, Q5 to be turned off and the transistors Q2, Q8, Q7, Q4 to be turned on. Thus, the node N1 attains the ground potential (0 V) and the potential VscnF of the node N3 attains Vscn. Since the transistor Q2 is turned on, the potential of the scan electrode SC1 attains the ground potential.

The control signals S8, S7 attain a low level and the transistors Q8, Q7 are turned off at the time point t1. Moreover, the control signals S1, S2 attain a low level. This causes the transistor Q1 to be turned on and the transistor Q2 to be turned off. Accordingly, the potential of the scan electrode SC1 rises to Vscn. The potential of the scan electrode SC1 is maintained at Vscn in a period from the time point t2 to the time point t3.

The control signal S3 attains a high level and the transistor Q3 is turned on at the time point t3. This causes the potential VFGND of the node N1 to gradually rise from the ground potential to Vset. In addition, the potential VscnF of the node N3 and the potential of the scan electrode SC1 rise from Vscn to (Vscn+Vset).

The control signal S3 attains a low level and the transistor Q3 is turned off at the time point t4. This causes the potential VFGND of the node N1 to be held at Vset. Moreover, the potential VscnF of the node N3 and the potential of the scan electrode SC1 are maintained at (Vscn+Vset).

The control signals S6, S7 attain a high level and the transistors Q6, Q7 are turned on at the time point t5. This causes the potential VFGND of the node N1 to drop to Vsus. In addition, the potential VscnF of the node N3 and the potential of the scan electrode SC1 drop to (Vscn+Vsus). The potential of the scan electrode SC1 is maintained at (Vscn+Vsus) in a period from a time point t5*a* to a time point t5*b*.

The control signals S1, S2 attain a high level at the time point t5*b*. This causes the transistor Q1 to be turned off and the transistor Q2 to be turned on. Thus, the potential of the scan electrode SC1 drops to Vsus. Accordingly, the potential of the scan electrode SC1 is maintained at Vsus in a period from the time point t6 to the time point t7.

The control signals S4, S6 attain a low level and the transistors Q4, Q6 are turned off at the time point t7. Moreover, the control signal S5 attains a high level, and the transistor Q5 is turned on. This causes the potential VFGND of the node N1 and the potential of the scan electrode SC1 to gradually drop toward (−Vad). In addition, the potential VscnF of the node N3 gradually drops toward (−Vad+Vscn).

The control signals S1, S2 attains a low level at the time point t8. This causes the transistor Q1 to be turned on and the transistor Q2 to be turned off. Accordingly, the potential of the scan electrode SC1 rises from (−Vad+Vset2) to (−Vad+Vscn). Here, Vset2<Vscn.

The control signal S8 attains a high level and the transistor Q8 is turned on at a time point t9 of the write period. This causes the node N4 to attain the ground potential. At this time, since the transistor Q4 is turned off, the node N1 and the potential of the scan electrode SC1 are maintained at (−Vad+Vscn).

At the time point t11, the control signals S1, S2 attain a high level. This causes the transistor Q1 to be turned off and the transistor Q2 to be turned on. Thus, the potential of the scan electrode SC1 drops from (−Vad+Vscn) to −Vad.

The control signals S1, S2 attain a low level at a time point t12. This causes the transistor Q1 to be turned off and the transistor Q2 to be turned on. Thus, the potential of the scan electrode SC1 rises from −Vad to (−Vad+Vscn). As a result, the scan pulse Pa (FIGS. 4 and 5) is generated in the scan electrode SC1.

Figure 10:
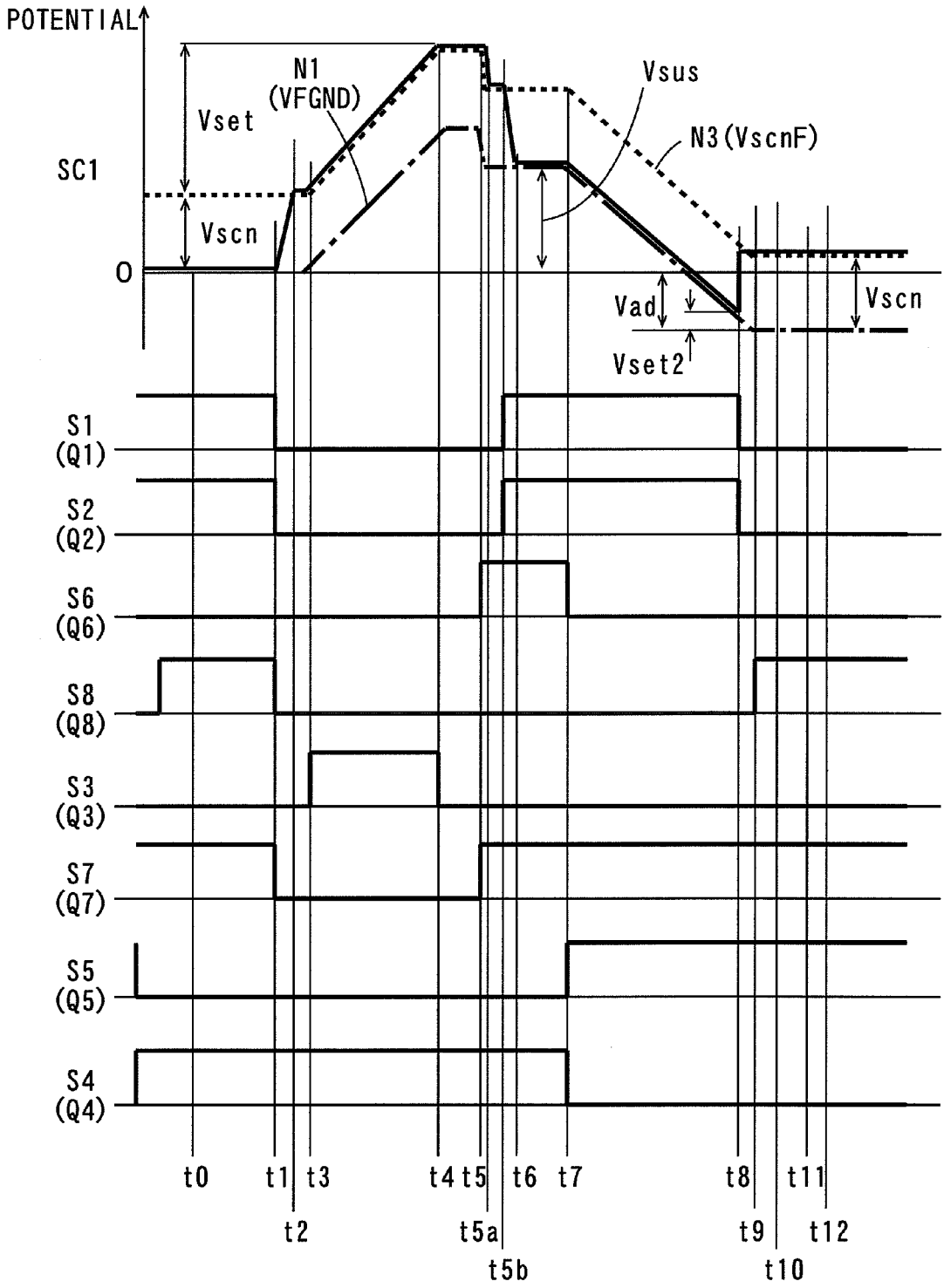
FIG. 10 is a detailed timing chart of control signals supplied to the scan electrode driving circuit 53 in the setup period and the write period of the first SF of FIGS. 6 and 7.

Next, description is made of the operation of the scan electrode driving circuit 53 performed based on the second driving method. FIG. 10 is a detailed timing chart of the control signals supplied to the scan electrode driving circuit 53 in the setup period and the write period of the first SF of FIGS. 6 and 7.

As shown in FIG. 10, in the second driving method, the scan electrode driving circuit 53 performs the same operation as that in the first driving method in a period from the time point t0 to the time point t10.

Then, the control signals S1, S2 are maintained at a low level at the time point t11. Thus, the transistor Q1 is maintained in an ON state and the transistor Q2 is maintained in an OFF state. This causes the potential of the scan electrode SC1 to be maintained at (−Vad+Vscn). As a result, the scan pulse Pa (FIGS. 4 and 5) is not generated in the scan electrode SC1 during the write period.

(5) Circuit Configuration and Operation of the Sustain Electrode Driving Circuit

(5-1) Circuit Configuration

Figure 11:
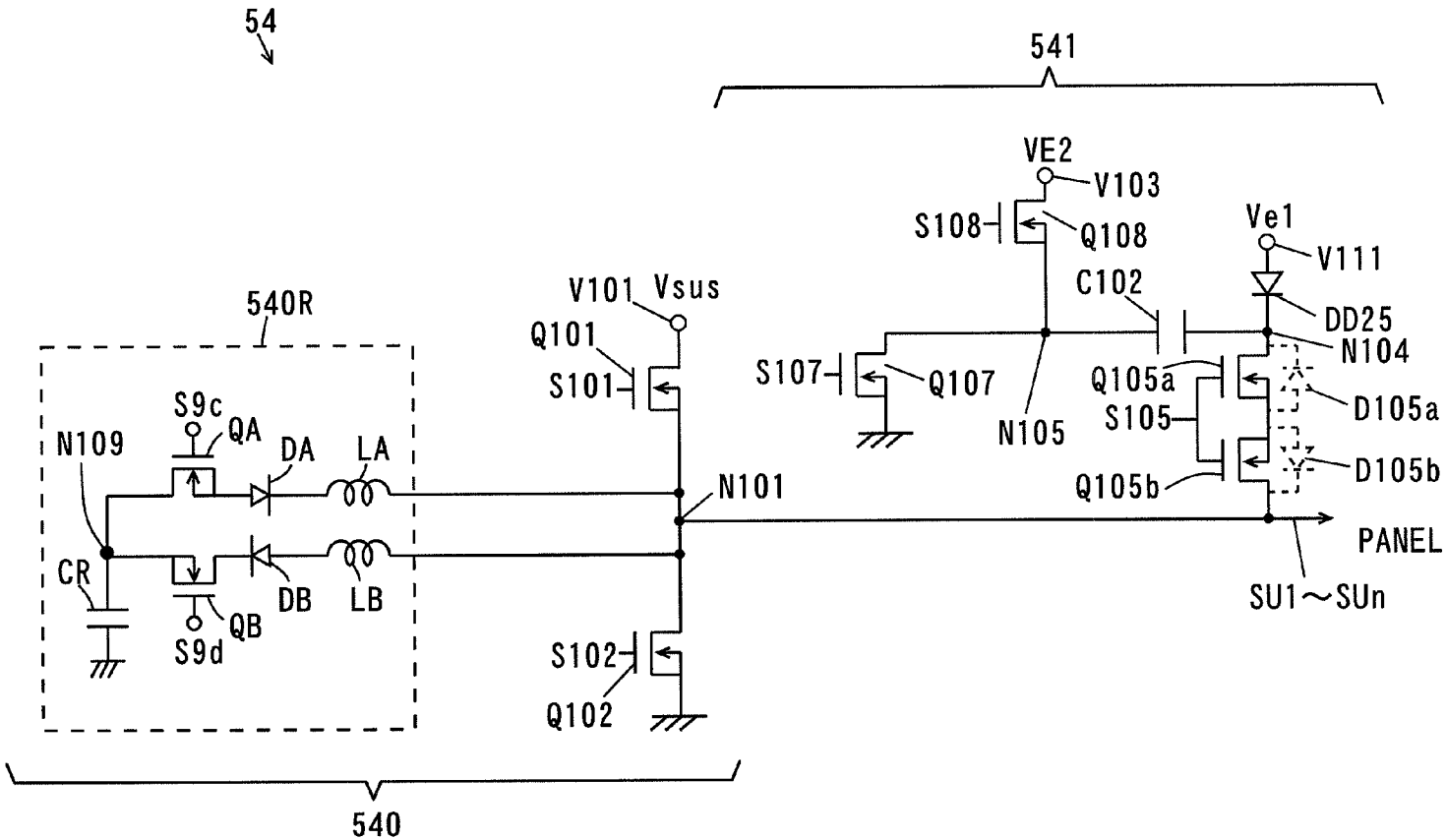
FIG. 11 is a circuit diagram showing the configuration of a sustain electrode driving circuit of FIG. 3.

FIG. 11 is a circuit diagram showing the configuration of the sustain electrode driving circuit 54 of FIG. 3.

The sustain electrode driving circuit 54 of FIG. 11 includes a sustain driver 540 and a voltage raising circuit 541.

As shown in FIG. 11, the sustain driver 540 includes n-channel field effect transistors (hereinafter abbreviated as transistors) Q101, Q102 and a recovery circuit 540R. The recovery circuit 540R includes n-channel field effect transistors (hereinafter abbreviated as transistors) QA, QB, recovery coils LA, LB, a recovery capacitor CR and diodes DA, DB.

The transistor Q101 of the sustain driver 540 is connected between a power supply terminal V101 that receives the voltage Vsus and a node N101, and a control signal S101 is supplied to a gate.

The transistor Q102 is connected between the node N101 and a ground terminal, and a control signal S102 is supplied to a gate. The node N101 is connected to the sustain electrodes SU1 to SUn of FIG. 2.

Between the node N101 and a node N109 of the recovery circuit 540R, the recovery coil LA, the diode DA and the transistor QA are connected in series, and the recovery coil LB, the diode DB and the transistor QB are connected in series. The recovery capacitor CR is connected between the node N109 and a ground terminal. A control signal S9*c* is supplied to a gate of the transistor QA and a control signal S9*d* is supplied to a gate of the transistor QB.

The voltage raising circuit 541 includes n-channel field-effect transistors (hereinafter abbreviated as transistors) Q105*a*, Q105*b*, Q107, Q108, a diode DD25 and a capacitor C102.

The diode DD25 of the voltage raising circuit 541 is connected between a power supply terminal V111 that receives the voltage Ve1 and a node N104.

The transistor Q105*a* and the transistor Q105*b* are connected in series between the node N104 and the node N101. Control signals S105 are supplied to gates of the transistor Q105*a* and the transistor Q105*b*, respectively. The capacitor C102 is connected between the node N104 and a node N105.

The transistor Q107 is connected between the node N105 and a ground terminal, and a control signal S107 is input to a gate. The transistor Q108 is connected between a power supply terminal V103 that receives the voltage VE2 and the node N105, and a control signal S108 is input to a gate. Note that the voltage VE2 satisfies a relation of VE2=Ve2−Ve1, such as VE2=5 [V].

The above-mentioned control signals S101, S102, S9*c*, S9*d*, S105, S107, S108 are supplied from the timing generating circuit 55 of FIG. 3 to the sustain electrode driving circuit 54 as the timing signals.

(5-2) Operation in the Setup Period and the Write Period

Figure 12:
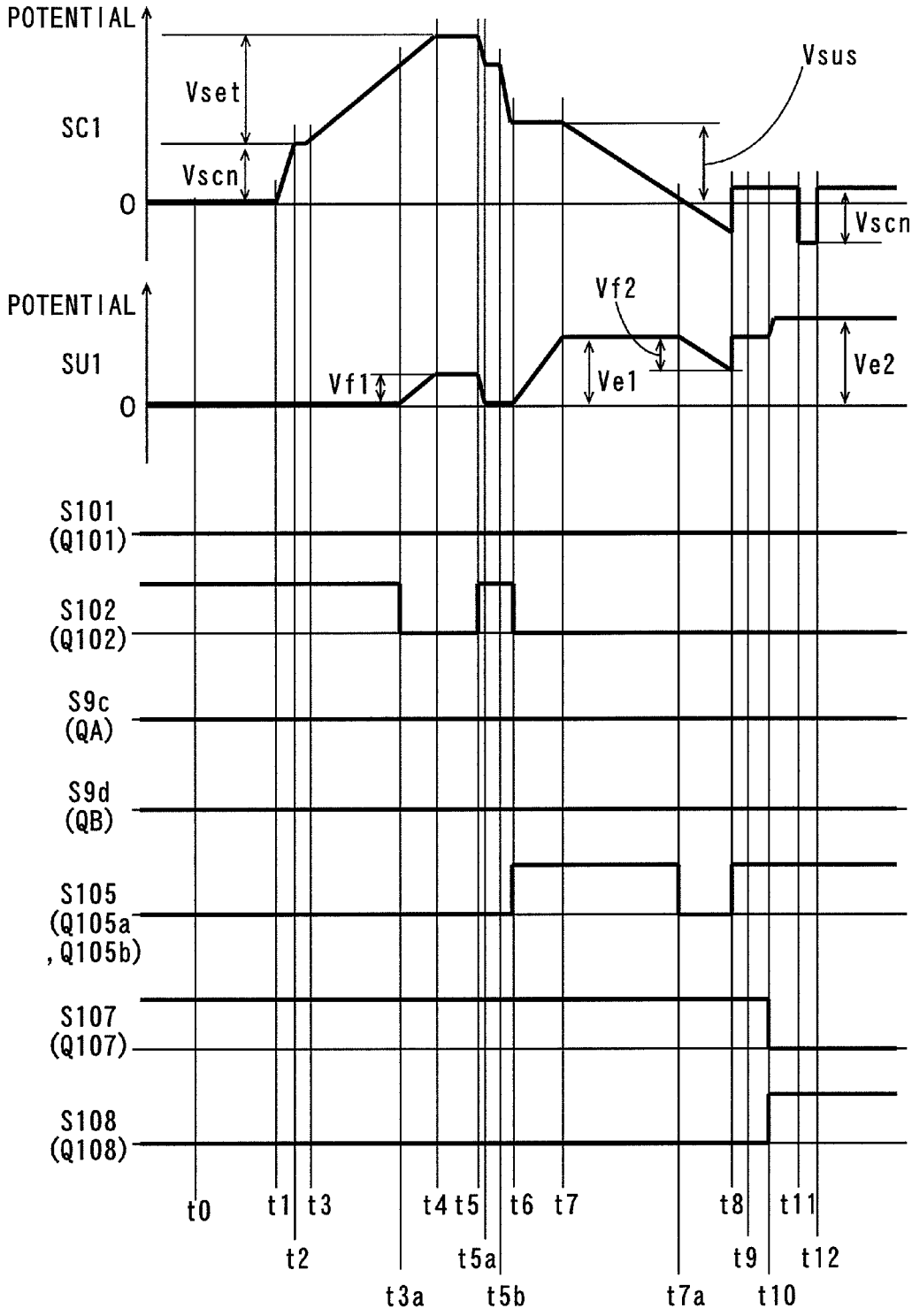
FIG. 12 is a detailed timing chart of control signals supplied to the sustain electrode driving circuit in the setup period and the write period of the first SF of FIGS. 4 and 5.

First, description is made of the operation of the sustain electrode driving circuit 54 performed based on the first driving method. FIG. 12 is a detailed timing chart of the control signals supplied to the sustain electrode driving circuit 54 in the setup period and the write period of the first SF of FIGS. 4 and 5.

Change in the potential of the scan electrode SC1 is shown in the top stage of FIG. 12 for reference. Change in the potential of the sustain electrode SU1 is shown in the next stage of FIG. 12.

At the starting time point t0 of the first SF, the control signals S101, S9*c*, S9*d*, S105, S108 are at a low level, and the control signals S102, S107 are at a high level. This causes the transistors Q101, QA, QB, Q105*a*, Q105*b*, Q108 to be turned off and the transistors Q102, Q107 to be turned on. Thus, the sustain electrode SU1 (the node N101) attains the ground potential.

The control signal S102 attains a low level at the time point t3*a* after the predetermined period of time has elapsed since the starting time point t0 of the first SF. This causes the transistor Q102 to be turned off. As a result, the sustain electrode SU1 is brought into the high impedance state. Accordingly, the potential of the sustain electrode SU1 rises by the voltage Vf1 with rising the potential of the scan electrode SC1. Since the potential of the scan electrode SC1 is maintained constant, the potential of the sustain electrode SU1 is also maintained constant in a period from the time point t4 to the time point t5.

The control signal S102 attains a high level at the time point t5. This causes the transistor Q102 to be turned on. As a result, the sustain electrode SU1 (the node N101) is again held at the ground potential.

The control signal S102 attains a low level and the control signal S105 attains a high level at the time point t6. Thus, the transistor Q102 is turned off and the transistors Q105*a*, Q105*b* are turned on. This causes a current to flow from the power supply terminal V111 to the sustain electrode SU1 through the node N104. As a result, the sustain electrode SU1 is raised to be held at Ve1 at the time point t7.

The control signal S105 attains a low level at the time point t7*a*. This causes the transistors Q105*a*, Q105*b* to be turned off. Thus, the sustain electrode SU1 is brought into the high impedance state. As a result, the potential of the sustain electrode SU1 gradually drops from Ve1 by the voltage Vf2 with dropping the potential of the scan electrode SC1 in the period from the time point t7*a* to the time point t8.

Then, the control signal S105 attains a high level at the time point t8. This causes the transistors Q105*a*, Q105*b* to be turned on. As a result, the potential of the sustain electrode SU1 (the node N101) is again held at Ve1.

The control signal S107 attains a low level and the control signal S108 attains a high level at the time point t10 of the write period. Thus, the transistor Q107 is turned off and the transistor Q108 is turned on. This causes the current to flow from the power supply terminal V103 to the node N105 through the transistor Q108. As a result, the potential of the node N105 rises to VE2. In this case, the voltage VE2 is added to the voltage Ve1 of the sustain electrode SU1. Thus, the potential of the sustain electrode SU1 (the node N101) rises to Ve2.

Figure 13:
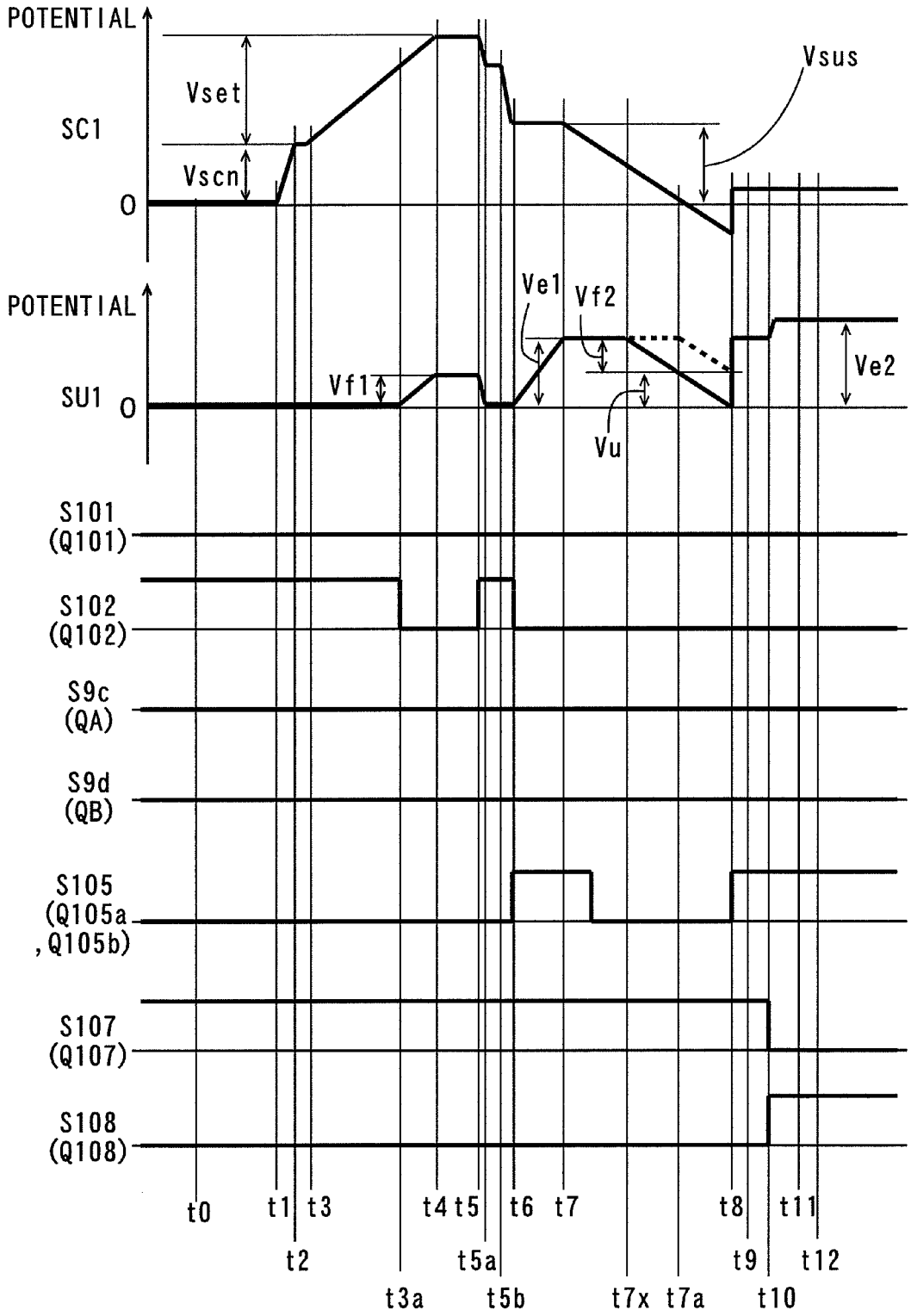
FIG. 13 is a detailed timing chart of control signals supplied to the sustain electrode driving circuit in the setup period and the write period of the first SF of FIGS. 6 and 7.

Next, description is made of the operation of the sustain electrode driving circuit 54 performed based on the second driving method. FIG. 13 is a detailed timing chart of the control signals supplied to the sustain electrode driving circuit 54 in the setup period and the write period of the first SF of FIGS. 6 and 7.

As shown in FIG. 13, in the second driving method, the sustain electrode driving circuit 54 performs the same operation as that in the first driving method in a period from the time point t0 to the time point t7.

Then, the control signal S105 attains a low level at the time point t7*x* that is earlier than the time point t7*a*. This causes the transistors Q105*a*, Q105*b* to be turned off. Accordingly, the sustain electrode SU1 is brought into the high impedance state. As a result, the potential of the sustain electrode SU1 gradually drops from Ve1 by the voltage (Vf2+Vu) with dropping the potential of the scan electrode SC1 in the period from the time point t7*x* to the time point t8.

Then, the control signal S105 attains a high level at the time point t8. This causes the transistors Q105*a*, Q105*b* to be turned on. As a result, the potential of the sustain electrode SU1 (the node N101) to be again held at Ve1. The sustain electrode driving circuit 54 performs the same operation as that in the first driving method at the time point t9 of the write period and later.

(6) Other Embodiments

In the first driving method, a ramp waveform or a step waveform gradually rising from the ground potential by the voltage Vf1 may be applied to the sustain electrode SUi in the first non-discharge period ND1 instead of bringing the sustain electrode SUi into the high impedance state. In addition, a ramp waveform or a step waveform gradually dropping from the positive potential Ve1 by the voltage Vf2 may be applied to the sustain electrode SUi in the second non-discharge period ND2. Also in this case, the same effects as the foregoing can be obtained.

In the second driving method, a ramp waveform or a step waveform gradually rising from the ground potential by the voltage Vf1 may be applied to the sustain electrode SUi in the first non-discharge period ND1 instead of bringing the sustain electrode SUi into the high impedance state. Moreover, a ramp waveform or a step waveform gradually dropping from the positive potential Ve1 by the voltage (Vf2+Vu) may be applied to the sustain electrode SUi in the fourth non-discharge period ND4. Also in this case, the same effects as the foregoing can be obtained.

While the setup operation for all cells is performed in the first SF in the foregoing embodiment, the setup operation for all cells may be performed in another sub-field. Moreover, the setup operation for all cells may be performed in a plurality of sub-fields.

The n-channel field effect transistors and the p-channel field effect transistors are used as the switching elements in the data electrode driving circuit 52, the scan electrode driving circuit 53 and the sustain electrode driving circuit 54 in the foregoing embodiment, the switching elements are not limited to the foregoing examples.

For example, a p-channel field effect transistor, an insulated gate bipolar transistor or the like may be employed instead of the n-channel field effect transistor, and an n-channel field effect transistor, an insulated gate bipolar transistor or the like may be employed instead of the p-channel field effect transistor in the above-described circuits.

Figure 14:
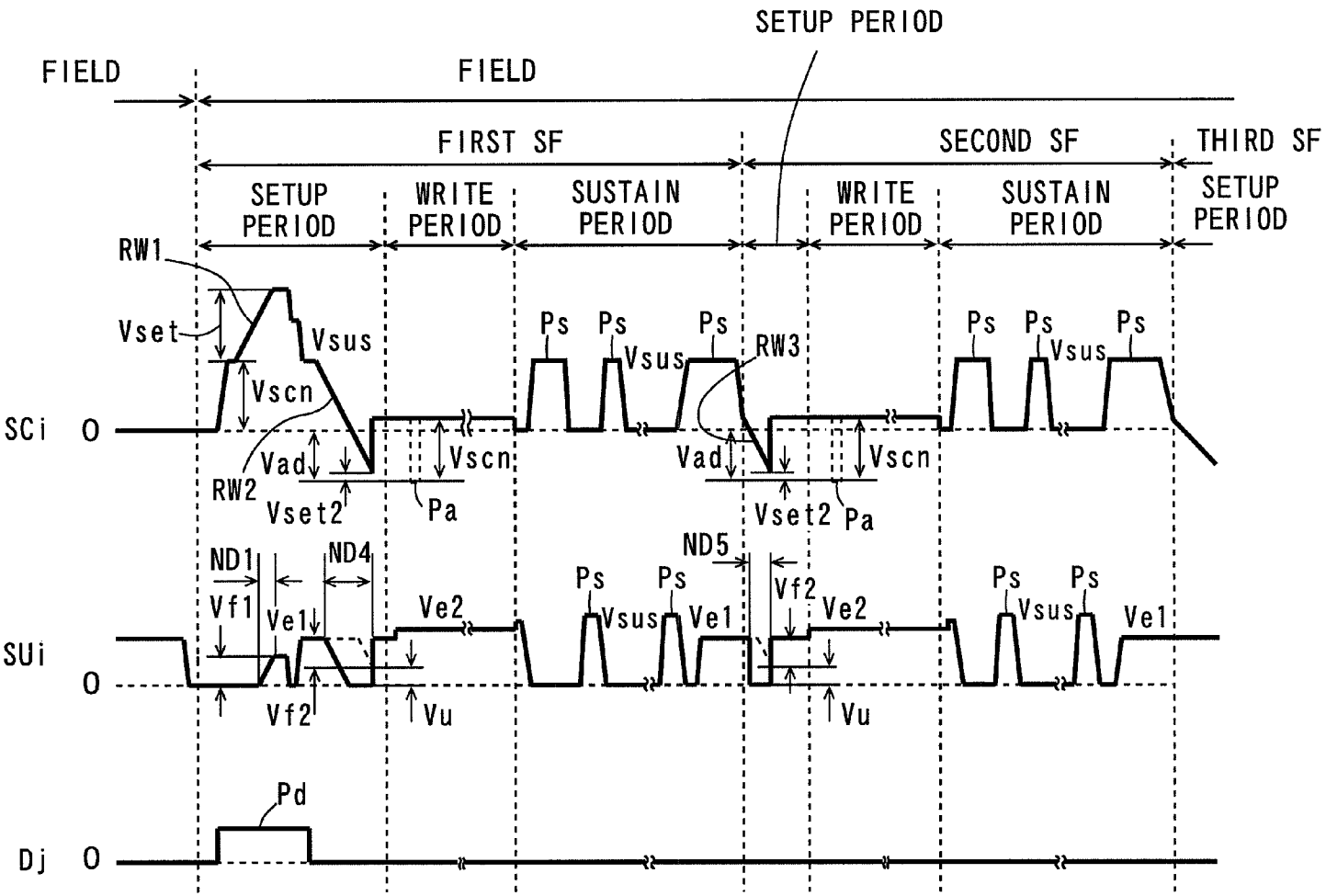
FIG. 14 is a diagram showing another example of the driving waveforms applied to respective electrodes of the plasma display apparatus by the second driving method.
Figure 15:
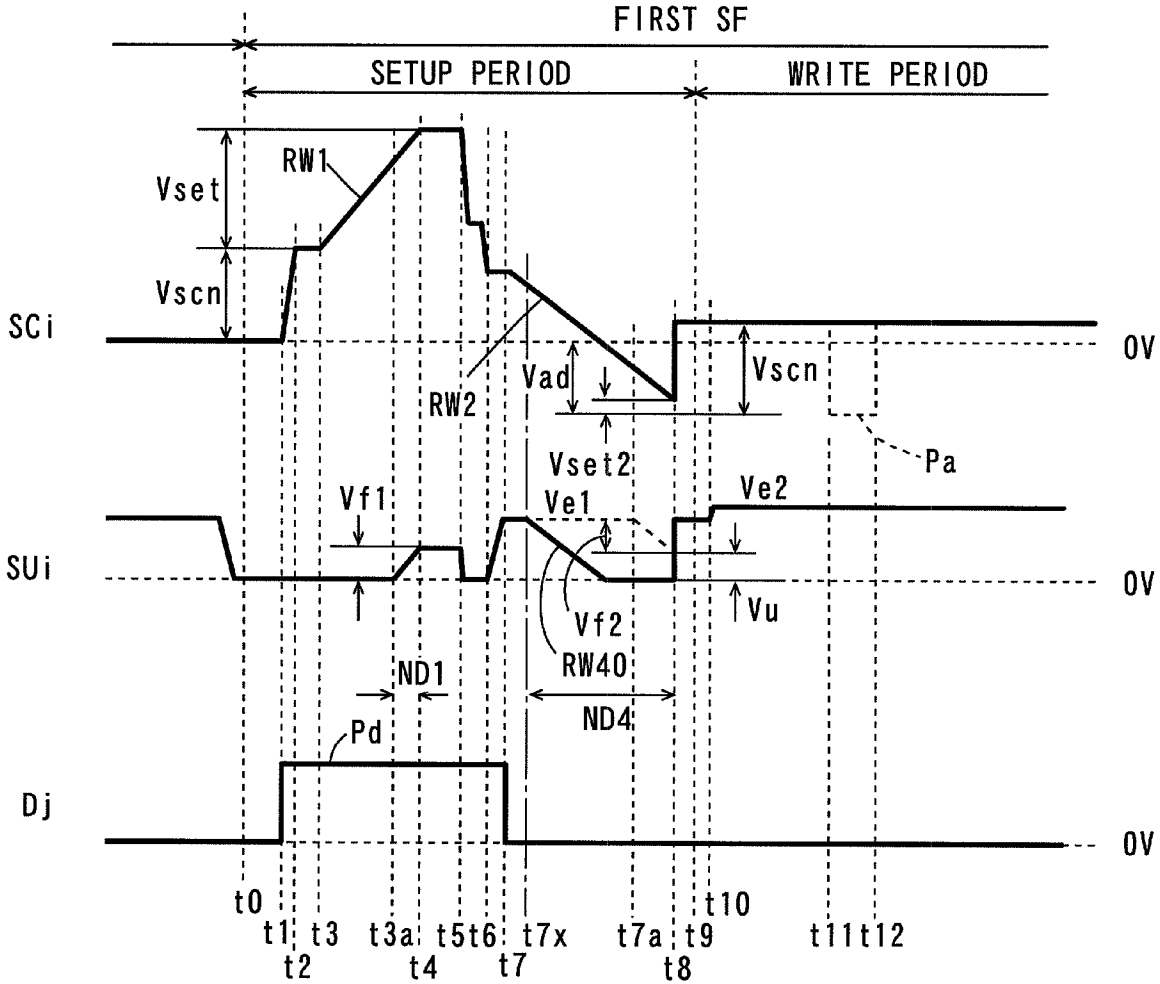
FIG. 15 is a partially enlarged view of the driving waveforms of FIG. 14.

The driving waveforms used in the second driving method are not limited to the foregoing waveforms. For example, driving waveforms described below may be employed. FIG. 14 is a diagram showing another example of the driving waveforms applied to the respective electrodes of the plasma display apparatus by the second driving method. FIG. 15 is a partially enlarged view of the driving waveforms of FIG. 14.

Similarly to FIGS. 4 to 7, FIG. 14 shows the driving waveforms in the period from the starting time point of the first SF to the setup period of the third SF of the one field. FIG. 15 shows the driving waveforms in the period from the setup period to the write period of the first SF of FIG. 14. Details of the setup period and the write period of the first SF are described based on FIG. 15.

As shown in FIG. 15, in the driving waveform, the timing (the time point t7*x*) at which the sustain electrode SUi is brought into the high impedance state in the drop period is further advanced as compared with the driving waveform of FIG. 7. Thus, the fourth non-discharge period ND4 from the time point t7*x* to the time point t8 is set significantly long.

As described above, when the sustain electrode SUi is in the high impedance state, the potential of the sustain electrode SUi changes according to the potential change of the scan electrode SCi, and the voltage between the scan electrode SCi and the sustain electrode SUi is maintained constant.

In this example, since the timing at which the sustain electrode SUi is brought into the high impedance state is greatly advanced, the potential of the sustain electrode SUi drops to the ground potential in the middle of the non-discharge period ND4. Here, the potential of the sustain electrode SUi does not drop below the ground potential. Therefore, the potential of the sustain electrode SUi drops to be maintained at the ground potential in the fourth non-discharge period ND4.

Therefore, a period in which the sustain electrode SUi is in the high impedance state equals to a period in which the potential of the sustain electrode SUi drops from the positive potential Ve1 to the ground potential in this example. Thus, a problem of whether the weak discharge is generated between the scan electrode SCi and the sustain electrode SUi may arise in a period (hereinafter abbreviated as a ground period), in which the sustain electrode SUi is not in the high impedance state, within the fourth non-discharge period ND4.

In the ground period, the potential of the sustain electrode SUi is lowered to the ground potential together with the potential of the scan electrode SCi. This suppresses an increase in the potential difference between the scan electrode SCi and the sustain electrode SUi.

Accordingly, the voltage between the scan electrode SCi and the sustain electrode SUi does not exceed the discharge start voltage as long as the potential of the scan electrode SCi is not greatly lowered. This inhibits generation of the weak discharge between the scan electrode SCi and the sustain electrode SUi in the ground period.

The period of generation of the weak discharge between the scan electrode SCi and the sustain electrode SUi is extremely short in this example. As a result, the same effects as those in the foregoing embodiment can be obtained also when the driving waveforms shown in FIGS. 14 and 15 are employed in the second driving method.

As described above, in the driving waveform used in the second driving method, the timing (the time point t7*x*) at which the sustain electrode SUi is brought into the high impedance state during the drop period may be advanced as compared with the driving waveform used in the first driving method.

(7) Correspondences between Elements in the Claims and Parts in Embodiments

In the following paragraphs, non-limiting examples of correspondences between various elements recited in the claims below and those described above with respect to various preferred embodiments of the present invention are explained.

(7-1) Claims 1 to 6

In the foregoing embodiments, the image signal processing circuit 51, the data electrode driving circuit 52, the scan electrode driving circuit 53, the sustain electrode driving circuit 54, the timing generating circuit 55, the all-black detecting circuit 56 and the power supply circuit are examples of a driving device, the all-black detecting circuit 56 is an example of a determiner, the drop period from the time point t7 to the time point t8 is an example of a first period, the potential Vsus is an example of a first potential, the potential (−Vad+Vset2) is an example of a second potential, and the ramp waveform RW2 is an example of a first ramp waveform.

The second non-discharge period ND2 is an example of a second period, the potential Ve1 is an example of a third potential, the potential (Ve1−Vf2) is an example of a fourth potential, the ramp waveform RW20 of the sustain electrode SUi in the second non-discharge period ND2 is an example of a second ramp waveform.

The fourth non-discharge period ND4 is an example of a third period, the ramp waveform RW40 of the sustain electrode SUi in the fourth non-discharge period ND4 is an example of a third ramp waveform, the potential (Ve1−Vf2−Vu) is an example of a fifth potential, the first sub-field in which the setup operation for all cells is performed is an example of at least one sub-field, and the rise period from the time point t3 to the time point t4 is an example of a fourth period.

The potential Vscn is an example of a sixth potential, the potential (Vscn+Vset) is an example of a seventh potential, the ramp waveform RW1 is an example of a fourth ramp waveform, the first non-discharge period ND1 is an example of a fifth period, the ground potential is an example of an eighth potential, the potential Vf1 is an example of a ninth potential, the ramp waveform RW10 of the sustain electrode SUi in the first non-discharge period ND1 is an example of a fifth ramp waveform.

The panel 10, the image signal processing circuit 51, the data electrode driving circuit 52, the scan electrode driving circuit 53, the sustain electrode driving circuit 54, the timing generating circuit 55, the all-black detecting circuit 56 and the power supply circuit are an example of a plasma display apparatus.

(7-2) Claim 7

The fourth non-discharge period ND4 is an example of a second period, the ramp waveform RW40 of the sustain electrode SUi in the fourth non-discharge period ND4 is an example of a second ramp waveform, and the potential (Ve1−Vf2−Vu) is an example of a fourth potential. Correspondences between other elements recited in claim 7 and those in embodiments are the same as those of claims 1 to 6.

As each of various elements recited in the claims, various other elements having configurations or functions described in the claims can be also used.

INDUSTRIAL APPLICABILITY

The present invention is applicable to a display apparatus that displays various images.

The invention claimed is:

1. A driving device that drives a plasma display panel including a plurality of discharge cells at intersections of a plurality of scan electrodes and a plurality of sustain electrodes with a plurality of data electrodes by a sub-field method in which one field period includes a plurality of sub-fields, comprising:

a scan electrode driving circuit that drives said plurality of scan electrodes;

a sustain electrode driving circuit that drives said plurality of sustain electrodes; and an all-black detecting circuit that determines whether at least one of said plurality of discharge cells lights up or all of said plurality of discharge cells do not light up in each field period, before start of the corresponding field period, wherein said scan electrode driving circuit applies a first ramp waveform dropping from a first potential to a second potential to said plurality of scan electrodes in a first period within a setup period of each sub-field in each field period, when said all-black detecting circuit determines that the at least one of said plurality of discharge cells lights up in one field period, said scan electrode driving circuit applies a scan pulse for write discharge to said plurality of scan electrodes in a write period of each sub-field in said one field period, and said sustain electrode driving circuit applies a second ramp waveform dropping from a third potential to a fourth potential to said plurality of sustain electrodes in a second period, which is shorter than said first period, within said first period of each sub-field in said one field period, and when said all-black detecting circuit determines that the at least one of said plurality of discharge cells does not light up in one field period, said scan electrode driving circuit does not apply the scan pulse to said plurality of scan electrodes in the write period of each sub-field in said one field period, and said sustain electrode driving circuit applies a third ramp waveform dropping from said third potential to a fifth potential to said plurality of sustain electrodes in a third period, which is shorter than said first period and longer than said second period, within said first period of each sub-field in said one field period.

2. The driving device according to claim 1, wherein said sustain electrode driving circuit brings said plurality of sustain electrodes into a floating state in said second period of each sub-field in one field period when said all-black detecting circuit determines that at least one of said plurality of discharge cells lights up in said one field period, and brings said plurality of sustain electrodes into the floating state in said third period of each sub-field in one field period when said all-black detecting circuit determines that all of said plurality of discharge cells do not light up in said one field period.

3. The driving device according to claim 1, wherein said scan electrode driving circuit applies a fourth ramp waveform rising from a sixth potential to a seventh potential to said plurality of scan electrodes for setup discharge in a fourth period, which precedes said first period, within the setup period of the at least one sub-field of each field period, and said sustain electrode driving circuit applies a fifth ramp waveform rising from an eighth potential to a ninth potential to said plurality of sustain electrodes in a fifth period, which is shorter than said fourth period, within said fourth period.

4. The driving device according to claim 3, wherein said sustain electrode driving circuit brings said plurality of sustain electrodes into a floating state in said fifth period.

5. A driving method that drives a plasma display panel including a plurality of discharge cells at intersections of a plurality of scan electrodes and a plurality of sustain electrodes with a plurality of data electrodes by a sub-field method in which one field period includes a plurality of sub-fields, comprising:

determining whether at least one of said plurality of discharge cells lights up or all of said plurality of discharge cells do not light up in each field period, before start of the corresponding field period;

applying a first ramp waveform dropping from a first potential to a second potential to said plurality of scan electrodes in a first period within a setup period of each sub-field of each field period;

applying a second ramp waveform dropping from a third potential to a fourth potential to said plurality of sustain electrodes in a second period, which is shorter than said first period, within said first period of each sub-field in one field period, and applying a scan pulse for write discharge to said plurality of scan electrodes in a write period of each sub-field when it is determined that the at least one of said plurality of discharge cells lights up in said one field period; and applying a third ramp waveform dropping from said third potential to a fifth potential to said plurality of sustain electrodes in a third period, which is shorter than said first period and longer than said second period, within said first period of each sub-field in one field period, and not applying the scan pulse to said plurality of scan electrodes in the write period of each field in said one field period when it is determined that all of said plurality of discharge cells do not light up in said one field period.

6. A plasma display apparatus, comprising:

a plasma display panel including a plurality of discharge cells at intersections of a plurality of scan electrodes and a plurality of sustain electrodes with a plurality of data electrodes; and a driving device that drives said plasma display panel by a sub-field method in which one field period includes a plurality of sub-fields, wherein said driving device includes:

a scan electrode driving circuit that drives said plurality of scan electrodes, a sustain electrode driving circuit that drives said plurality of sustain electrodes; and an all-black detecting circuit that determines whether at least one of said plurality of discharge cells lights up or all of said plurality of discharge cells do not light up in each field period, before start of the corresponding field period, wherein said scan electrode driving circuit applies a first ramp waveform dropping from a first potential to a second potential to said plurality of scan electrodes in a first period within a setup period of each sub-field in each field period, when said all-black detecting circuit determines that the at least one of said plurality of discharge cells lights up in one field period, said scan electrode driving circuit applies a scan pulse for write discharge to said plurality of scan electrodes in a write period of each sub-field in said one field period, and said sustain electrode driving circuit applies a second ramp waveform dropping from a third potential to a fourth potential to said plurality of sustain electrodes in a second period, which is shorter than said first period, within said first period of each sub-field in said one field period, and when said all-black detecting circuit determines that the at least one of said plurality of discharge cells does not light up in one field period, said scan electrode driving circuit does not apply the scan pulse to said plurality of scan electrodes in the write period of each sub-field in said one field period, and said sustain electrode driving circuit applies a third ramp waveform dropping from said third potential to a fifth potential to said plurality of sustain electrodes in a third period, which is shorter than said first period and longer than said second period, within said first period of each sub-field in said one field period.

7. A driving device that drives a plasma display panel including a plurality of discharge cells at intersections of a plurality of scan electrodes and a plurality of sustain electrodes with a plurality of data electrodes by a sub-field method in which one field period includes a plurality of sub-fields, comprising:

a scan electrode driving circuit that drives said plurality of scan electrodes;

a sustain electrode driving circuit that drives said plurality of sustain electrodes; and an all-black detecting circuit that determines whether at least one of said plurality of discharge cells lights up or all of said plurality of discharge cells do not light up in each field period, before start of the corresponding field period, wherein said scan electrode driving circuit applies a first ramp waveform dropping from a first potential to a second potential to said plurality of scan electrodes in a first period within a setup period of each sub-field in each field period, and when said all-black detecting circuit determines that at least one of said plurality of discharge cells does not light up in one field period, said scan electrode driving circuit does not apply a scan pulse to said plurality of scan electrodes in a write period of each sub-field in said one field period, and said sustain electrode driving circuit applies a second ramp waveform dropping from said third potential to a fourth potential to said plurality of sustain electrodes in a second period, which is shorter than said first period, within said first period of each sub-field in said one field period.

* * * * *